US011701899B2

(12) United States Patent
Toya et al.

(10) Patent No.: US 11,701,899 B2
(45) Date of Patent: Jul. 18, 2023

(54) LIQUID CIRCULATING DEVICE, LIQUID DISCHARGING APPARATUS, AND BUBBLE EXHAUSTING METHOD IN LIQUID DISCHARGING APPARATUS

(71) Applicant: Seiko Epson Corporation, Tokyo (JP)

(72) Inventors: Akihiro Toya, Shiojiri (JP); Satoshi Inomata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/552,144

(22) Filed: Dec. 15, 2021

(65) Prior Publication Data

US 2022/0194090 A1 Jun. 23, 2022

(30) Foreign Application Priority Data

Dec. 18, 2020 (JP) ..... 2020-210204
Jan. 15, 2021 (JP) ..... 2021-005162

(51) Int. Cl.
*B41J 2/18* (2006.01)
*B41J 2/14* (2006.01)
*B41J 2/175* (2006.01)

(52) U.S. Cl.
CPC ..... *B41J 2/18* (2013.01); *B41J 2/14016* (2013.01); *B41J 2/17596* (2013.01)

(58) Field of Classification Search
CPC ..... B41J 2/17566; B41J 2/19; B41J 2/14016; B41J 2/18; B41J 2/17556; B41J 2/17596; B41J 2002/17579
See application file for complete search history.

(56) References Cited

U.S. PATENT DOCUMENTS

| | | | | |
|---|---|---|---|---|
| 9,904,228 | B2 | 2/2018 | Xie et al. | |
| 10,654,283 | B2 * | 5/2020 | Saeki | B41J 29/38 |
| 10,850,530 | B2 * | 12/2020 | Otis, Jr. | B41J 2/17563 |
| 11,072,185 | B2 * | 7/2021 | Shiohara | B41J 2/17563 |
| 11,267,248 | B2 * | 3/2022 | Komatsu | B41J 2/19 |
| 2015/0329303 | A1 | 11/2015 | Xie et al. | |
| 2019/0009561 | A1 | 1/2019 | Mukoyama et al. | |
| 2020/0086651 | A1 | 3/2020 | Eto | |

FOREIGN PATENT DOCUMENTS

| | | |
|---|---|---|
| CN | 105084058 | 11/2015 |
| JP | 2019-014154 | 1/2019 |
| JP | 2020-044726 | 3/2020 |

* cited by examiner

*Primary Examiner* — An H Do
(74) *Attorney, Agent, or Firm* — Workman Nydegger

(57) ABSTRACT

A liquid circulating device has: a supply flow path through which a liquid is supplied from a liquid supply source that stores the liquid to a liquid ejecting head that ejects the liquid; a collection flow path through which the liquid collected from the liquid ejecting head is returned to the supply flow path; and a liquid flowing portion that causes the liquid to flow in a circulation flow path including the supply flow path, the liquid ejecting head, and the collection flow path. An air capturing portion can capture bubbles and is provided in at least one of the supply flow path and collection flow path. The air capturing portion is disposed at a position higher than the position of the liquid ejecting head.

15 Claims, 14 Drawing Sheets

LIQUID CIRCULATING DEVICE, LIQUID DISCHARGING APPARATUS, AND BUBBLE EXHAUSTING METHOD IN LIQUID DISCHARGING APPARATUS

The present application is based on, and claims priority from JP Application Serial Number 2020-210204, filed Dec. 18, 2020 and JP Application Serial Number 2021-005162, filed Jan. 15, 2021, the disclosures of which are hereby incorporated by reference herein in their entirety.

BACKGROUND

1. Technical Field

The present disclosure relates to a liquid circulating device, a liquid discharging apparatus, and a bubble exhausting method in the liquid discharging apparatus.

2. Related Art

A recording apparatus as described in, for example, JP-A-2019-014154 is an example of a liquid discharging apparatus that performs printing by discharging ink, which is an example of a liquid, from a head unit, which is an example of a liquid ejecting head. The recording apparatus has an ink supply unit, which is an example of a liquid circulating device. The ink supply unit has a supply flow path through which ink is supplied from a sub-tank to the head unit, and also has a collection flow path through which ink is collected from the head unit into the sub-tank.

A bubble may enter a liquid. A bubble in a flowing liquid moves together with the liquid. In the ink supply unit described in JP-A-2019-014154, when circulation is stopped in the middle, bubbles may gather together in the head. Therefore, all bubbles need to be exhausted at once in one circulation. This requires a plurality of pumps used to exhaust bubbles.

SUMMARY

A liquid circulating device that solves the above problem has: a supply flow path through which a liquid is supplied from a liquid supply source that stores the liquid to a liquid ejecting head that ejects the liquid; a collection flow path through which the liquid collected from the liquid ejecting head is returned to the supply flow path; and a liquid flowing portion that causes the liquid to flow in a circulation flow path including the supply flow path, the liquid ejecting head, and the collection flow path. An air capturing portion is configured to capture a bubble and is provided in at least one of the supply flow path and the collection flow path. The air capturing portion is disposed at a position higher than the position of the liquid ejecting head.

A liquid discharging apparatus that solves the above problem has:

a plurality of liquid circulating devices described above; and the liquid ejecting head that discharges the liquid. The plurality of liquid circulating devices have a single liquid flowing portion shared by the liquid circulating devices. The single liquid flowing portion has an air pressurizing portion that supplies air to the plurality of downstream storing portions to pressurize the interiors of the downstream storing portions. The air pressurizing portion is configured to concurrently pressurize the interiors of the plurality of downstream storing portions.

A bubble exhausting method that solves the above problem is used in a liquid discharging apparatus composed of a liquid ejecting head that discharges a liquid, a supply flow path through which the liquid is supplied from a liquid supply source that stores the liquid to the liquid ejecting head, a collection flow path through which the liquid collected from the liquid ejecting head is returned to the supply flow path, and a liquid flowing portion that causes the liquid to flow in a circulation flow path including the supply flow path, the liquid ejecting head, and the collection flow path. An air capturing portion is configured to capture a bubble and is provided in at least one of the supply flow path and the collection flow path. The air capturing portion is composed of a turnaround portion disposed at a position higher than the position of the liquid ejecting head in the at least one of the supply flow path and the collection flow path. The turnaround portion is composed of a rising flow path through which the liquid rises and a falling flow path through which the liquid falls. The falling flow path is disposed downstream of the rising flow path in a circulation direction. The method includes: a first flow process of causing the liquid flowing portion to cause the liquid to flow until a bubble present in the liquid ejecting head reaches the rising flow path or the falling flow path; a wait process of waiting for an air capturing time in a state in which a flow of the liquid is stopped; and a second flow process of causing the liquid flowing portion to cause the liquid to flow until the bubble captured in the air capturing portion is fed to the supply flow path.

DESCRIPTION OF EXEMPLARY EMBODIMENTS

Figure 1:
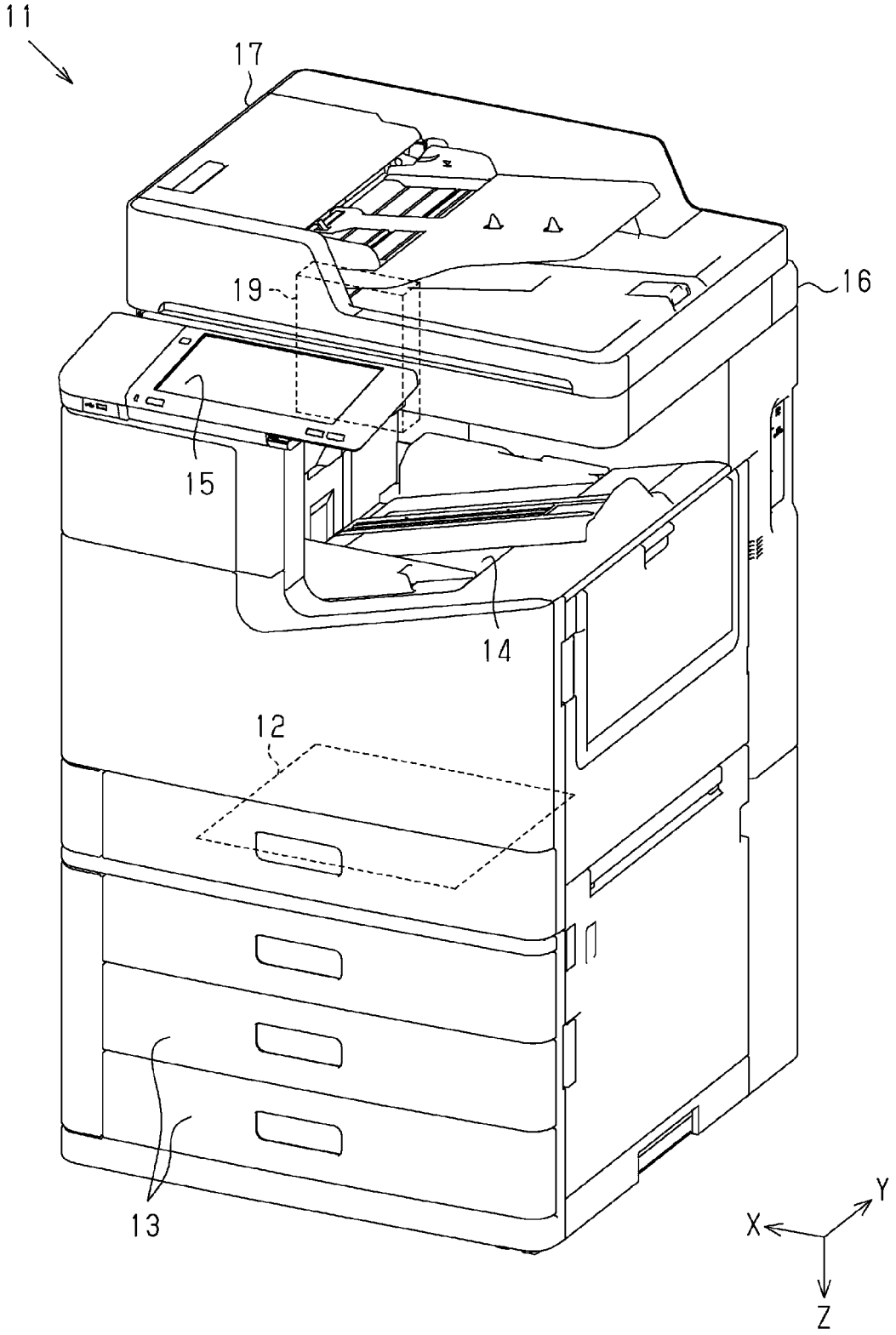
FIG. 1 is a perspective view illustrating a liquid discharging apparatus in a first embodiment to a fourth embodiment.

A liquid circulating device, a liquid discharging apparatus, and a bubble exhausting method in a first embodiment will be described below with reference to the drawings. The liquid discharging apparatus is, for example, an ink jet printer that performs printing by discharging ink, which is an example of a liquid, to a medium such as a sheet.

In the drawings, assuming that the liquid discharging apparatus 11 is placed on a horizontal plane, the direction of gravity will be indicated as the Z direction and directions along the horizontal plane will be indicated as the X axis and Y axis. The X axis, Y axis, and Z axis are mutually orthogonal.

First Embodiment

Structure of the Liquid Discharging Apparatus 11

The liquid discharging apparatus 11 may have medium storage portions 13 that can store media 12, a stacker 14 that receives a medium 12 on which printing has been performed, and a manipulation portion 15, such as, for example, a touch panel, used to manipulate the liquid discharging apparatus 11, as illustrated in FIG. 1. The liquid discharging apparatus 11 may have an image read portion 16 that reads an image on an original and an automatic feeding portion 17 that feeds an original to the image read portion 16.

The liquid discharging apparatus 11 has a control portion 19 that controls various operations executed in the liquid discharging apparatus 11. The control portion 19 may be structured as at least one processor that performs various processing according to a computer program, as at least one special hardware circuit, such as an application-specific integrated circuit, that executes at least part of various processing, or as a circuit that includes a combination of both. The processor includes a central processing unit (CPU) and memories such as a random-access memory (RAM) and a read-only memory (ROM). A memory stores program code or commands configured to cause the CPU to execute processing. A memory, that is, a computer-readable medium, is any of all readable medium that a general-purpose or special-purpose computer can access.

Figure 2:
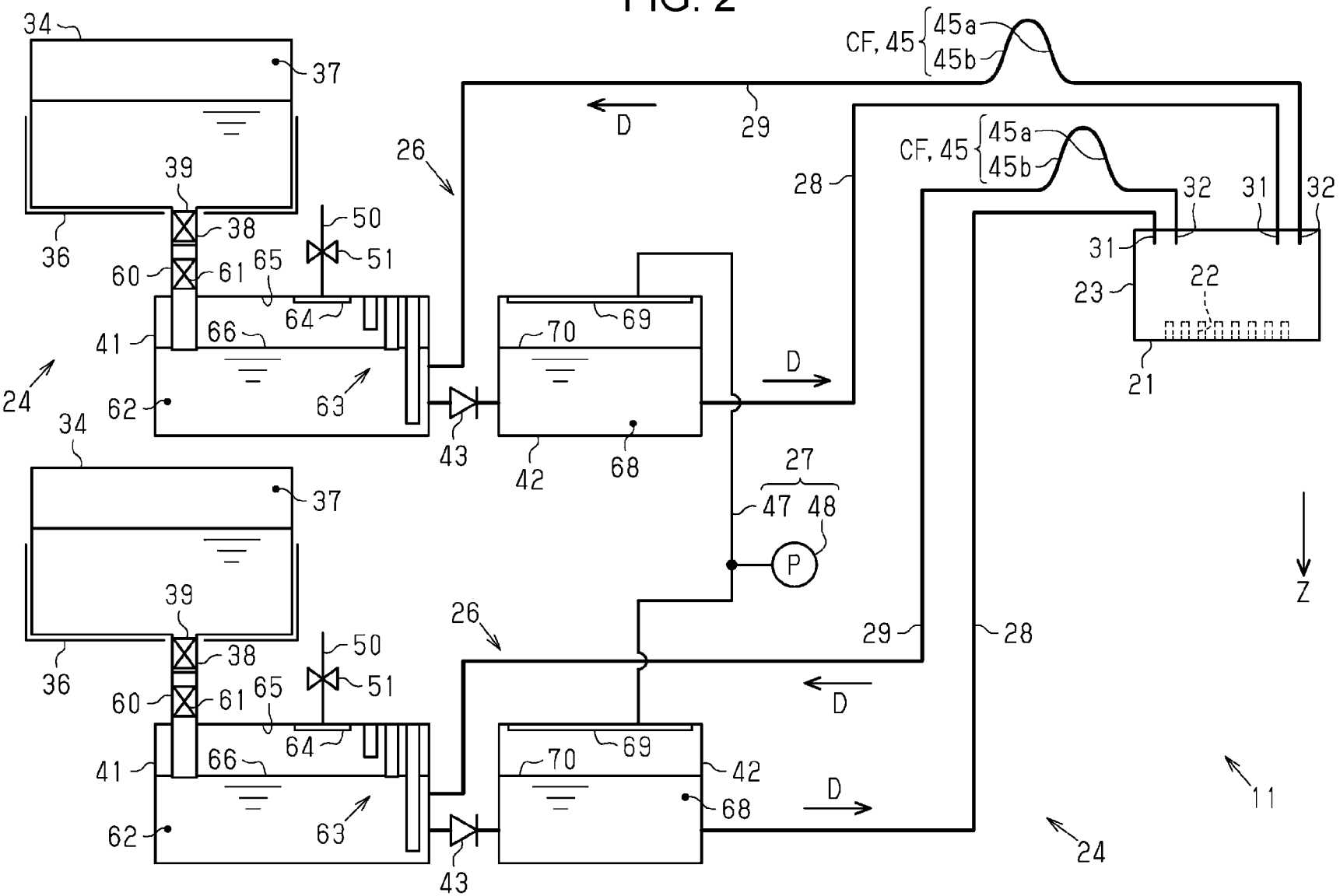
FIG. 2 is a schematic view illustrating an example of a liquid circulating device included in the liquid discharging apparatus in the first embodiment.

As illustrated in FIG. 2, the liquid discharging apparatus 11 has a liquid circulating device 24 and a liquid ejecting head 23 that discharges a liquid from nozzles 22 formed in a nozzle plane 21. The liquid discharging apparatus 11 may have a plurality of liquid circulating devices 24. The liquid discharging apparatus 11 in this embodiment has two liquid circulating devices 24. The two liquid circulating devices 24 have the same structure. Therefore, common component elements will be given the same reference numerals, and repeated descriptions will be omitted.

The liquid circulating device 24 has a circulation flow path 26, a liquid flowing portion 27 that causes the liquid to flow in the circulation flow path 26. The circulation flow path 26 includes a supply flow path 28, the liquid ejecting head 23, and a collection flow path 29. The liquid ejecting head 23 may have a first coupling portion 31 to which the supply flow path 28 is coupled and a second coupling portion 32 to which the collection flow path 29 is coupled.

Through the supply flow path 28, a liquid stored in a liquid supply source 34 is supplied to the liquid ejecting head 23. Through the collection flow path 29, the liquid collected from the liquid ejecting head 23 is returned to the supply flow path 28. The plurality of liquid circulating devices 24 may share a single liquid flowing portion 27. The liquid flowing portion 27 causes the liquid in the circulation flow path 26 to flow in a circulation direction D.

Each of the plurality of liquid circulating devices 24 may supply a different type of liquid to the liquid ejecting head 23. For example, the liquid discharging apparatus 11 may discharge inks in a plurality of colors supplied from the plurality of liquid circulating devices 24 to perform color printing.

The liquid ejecting head 23 may be detachably mounted in the main body of the liquid discharging apparatus 11. The liquid ejecting head 23 in this embodiment is a line-type head disposed across the width of the medium 12. However, the liquid ejecting head 23 may be a serial-type head that performs printing while moving in the width direction of the medium 12.

The liquid discharging apparatus 11 may have volumeing portion 36 in which the liquid supply source 34 is detachably mounted. The liquid supply source 34 may have a storage chamber 37 that stores a liquid, a leading-out portion 38 through which the liquid stored in the storage chamber 37 is led out, and a storage-portion-side valve 39 attached to the leading-out portion 38. The storage chamber 37 in this embodiment is a sealed space that does not communicate with the air. Before the liquid supply source 34 is mounted in the mounting portion 36, the liquid supply source 34 may store a liquid by an volume greater than the volume of the circulation flow path 26.

In the circulation direction D, the upstream end of the supply flow path 28 is coupled to the liquid supply source 34 and the downstream end of the supply flow path 28 is coupled to the first coupling portion 31. The supply flow path 28 may have an upstream storing portion 41 and a downstream storing portion 42, each of which can hold the liquid supplied from the liquid supply source 34. In the supply flow path 28, the downstream storing portion 42 is disposed downstream of the upstream storing portion 41 in the circulation direction D. That is, the downstream storing portion 42 is disposed between the upstream storing portion 41 and the liquid ejecting head 23. The liquid circulating device 24 may have a valve 43 disposed between the upstream storing portion 41 and the downstream storing portion 42 in the supply flow path 28.

The collection flow path 29 causes the liquid ejecting head 23 and upstream storing portion 41 to communicate with each other. In the circulation direction D, the upstream end of the collection flow path 29 is coupled to the second coupling portion 32 and the downstream end of the collection flow path 29 is coupled to the upstream storing portion 41. An air capturing portion 45 that can capture bubbles is provided in the collection flow path 29. The air capturing portion 45 is disposed at a position higher than the position of the liquid ejecting head 23. Specifically, the air capturing portion 45 is disposed at a position higher than the position of the liquid flow path in the liquid ejecting head 23. More specifically, the air capturing portion 45 is disposed at a position higher than the position of the second coupling portion 32 at which the collection flow path 29, in which the air capturing portion 45 is disposed, is coupled to the liquid ejecting head 23.

The air capturing portion 45 may be composed of one or more turnaround portions CF. In this embodiment, the air capturing portion 45 is composed of one turnaround portion CF disposed at the highest position in the supply flow path 28 and collection flow path 29. The turnaround portion CF is composed of a rising flow path 45*a* through which the liquid flowing in the circulation direction D rises and a falling flow path 45*b* through which the liquid flowing in the circulation direction D falls. The falling flow path 45*b* is disposed downstream of the rising flow path 45*a* in the circulation direction D.

One liquid flowing portion 27 may have a pressuring flow path 47 coupled to each of a plurality of downstream storing portions 42 as well as an air pressurizing portion 48 that supplies air to the plurality of downstream storing portions 42 through the pressuring flow path 47. The air pressurizing portion 48 pressurizes the interior of each downstream storing portion 42. The air pressurizing portion 48 can concurrently pressurize the plurality of downstream storing portions 42.

The air pressurizing portion 48 is, for example, a tube pump that feeds air while a roller rotates and crushes a tube. One end of the tube (not illustrated) in the air pressurizing portion 48 is open, and the other end of the tube is coupled to the pressuring flow path 47. When the normal rotation of the air pressurizing portion 48 is driven, the air pressurizing portion 48 inhales air and feeds the inhaled air to the pressuring flow path 47. When the reverse rotation of the air pressurizing portion 48 is driven, the roller frees the tube, causing the interior of the pressuring flow path 47 and the interior of the downstream storing portion 42 to communicate with the air.

The liquid circulating device 24 may have an atmosphere communication path 50 coupled to the upstream storing portion 41 as well as an atmosphere release valve 51 disposed in the atmosphere communication path 50. When the atmosphere release valve 51 is opened, the atmosphere communication path 50 is made open, causing the upstream storing portion 41 to communicate with the air.

Next, the upstream storing portion 41 will be described. The upstream storing portion 41 has a leading-in portion 60 into which the liquid stored in the liquid supply source 34 mounted in the mounting portion 36 can be led. The upstream storing portion 41 may have a device-side valve 61 attached to the leading-in portion 60, a first holding chamber 62 that holds a liquid, a liquid-level sensor 63 that detects the volume of liquid held in the first holding chamber 62, and a first gas-liquid separating film 64 that separates the first holding chamber 62 and atmosphere communication path 50 from each other. The first gas-liquid separating film 64 has the property that a gas passes through the first gas-liquid separating film 64 but a liquid does not pass through the first gas-liquid separating film 64.

The storage-portion-side valve 39 and device-side valve 61 are opened when the liquid supply source 34 is mounted in the mounting portion 36, and keep the open state while the liquid supply source 34 is mounted in the mounting portion 36. During the mounting of the liquid supply source 34 in the mounting portion 36, when an arrangement is made so that the device-side valve 61 is opened earlier than the storage-portion-side valve 39, the fear that the liquid leaks from the liquid supply source 34 can be reduced.

The leading-in portion 60 is disposed in the upper part of the upstream storing portion 41. The leading-in portion 60 in this embodiment passes through the ceiling 65 of the first holding chamber 62. The lower end of the leading-in portion 60 is positioned in the first holding chamber 62 and thereby below the ceiling 65. The upper end of the leading-in portion 60 is positioned outside the first holding chamber 62 and thereby above the ceiling 65. When the liquid supply source 34 is mounted in the mounting portion 36, the leading-in portion 60 is coupled to the leading-out portion 38 of the liquid supply source 34.

The lower end of the leading-in portion 60 is positioned below the nozzle plane 21. Therefore, the first liquid surface 66 of the liquid held in the upstream storing portion 41 varies within a range lower than the nozzle plane 21. Specifically, the liquid in the liquid supply source 34 is supplied to the upstream storing portion 41 through the leading-out portion 38 and leading-in portion 60 due to the head of the liquid in the liquid supply source 34. Air is led from the upstream storing portion 41 through the leading-in portion 60 and leading-out portion 38 into the liquid supply source 34 by an volume equal to the volume of liquid supplied to the upstream storing portion 41. The first liquid surface 66 is raised by an volume equal to the volume of supplied liquid. When the first liquid surface 66 reaches the lower end of the leading-in portion 60, the flow-in of air from the upstream storing portion 41 into the liquid supply source 34 is restricted. Since the storage chamber 37 is sealed, when the flow-in of air is restricted, the pressure in the storage chamber 37 is reduced by an volume equal to the volume of supplied liquid. When the negative pressure in the storage chamber 37 exceeds the head of the liquid in the storage chamber 37, the supply of the liquid from the liquid supply source 34 to the upstream storing portion 41 is restricted.

When the liquid is supplied from the upstream storing portion 41 to the downstream storing portion 42, the first liquid surface 66 drops. When the first liquid surface 66 drops and air thereby flows into the storage chamber 37 through the leading-in portion 60 and leading-out portion 38, the negative pressure in the storage chamber 37 is reduced. The negative pressure in the storage chamber 37 becomes lower than the head of the liquid in the storage chamber 37, the liquid is supplied from the liquid supply source 34 to the upstream storing portion 41. Therefore, while the liquid is stored in the liquid supply source 34, the first liquid surface 66 is maintained at a standard position in the vicinity of the lower end of the leading-in portion 60. When there is no more liquid in the liquid supply source 34, the first liquid surface 66 drops below the standard position.

The liquid-level sensor 63 may detect that the first liquid surface 66 is at the standard position, the first liquid surface 66 is below the standard position, and the first liquid surface 66 is at a full position, which is above the standard position. When the first liquid surface 66 is at the full position, the upstream storing portion 41 holds the maximum volume of liquid. When the liquid-level sensor 63 detects that the first liquid surface 66 is below the standard position, the control portion 19 may decide that the liquid supply source 34 has become empty and may command the user to replace the liquid supply source 34.

The standard position in this embodiment is above the position at which the downstream end of the collection flow path 29 is coupled in the first holding chamber 62. When the first liquid surface 66 is at the standard position, therefore, the liquid in the upstream storing portion 41 can be supplied to the liquid ejecting head 23 through the collection flow path 29.

Next, the downstream storing portion 42 will be described. The downstream storing portion 42 may have a second holding chamber 68 that holds a liquid as well as a second gas-liquid separating film 69 that separates the second holding chamber 68 and pressuring flow path 47 from each other. The second gas-liquid separating film 69 has the property that a gas passes through the second gas-liquid separating film 69 but a liquid does not pass through the second gas-liquid separating film 69 as with the first gas-liquid separating film 64.

The liquid in the upstream storing portion 41 is supplied to the downstream storing portion 42 due to the difference between the head of the liquid in the upstream storing portion 41 and that in the downstream storing portion 42. The valve 43 may have a check valve that permits a flow of the liquid from the upstream storing portion 41 to the downstream storing portion 42 but restricts a flow of the liquid from the downstream storing portion 42 to the upstream storing portion 41. When the interior of the first holding chamber 62 and the interior of the second holding chamber 68 are at the atmospheric pressure, the second liquid surface 70 of the liquid in the downstream storing portion 42 is at the same height as the first liquid surface 66. In other words, the second liquid surface 70 is maintained at the standard position, which is substantially at the same height as the lower end of the leading-in portion 60, and varies within a range lower than the nozzle plane 21. The liquid in the liquid ejecting head 23 is maintained at a negative pressure due to the difference between the head of the liquid in the upstream storing portion 41 and that in the downstream storing portion 42. When the liquid in the liquid ejecting head 23 is consumed, the liquid held in the downstream storing portion 42 is supplied to the liquid ejecting head 23.

When the pressure in the downstream storing portion 42 is higher than the pressure in the upstream storing portion 41, the valve 43 closes the supply flow path 28. When the air pressurizing portion 48 is to pressurize the interior of the downstream storing portion 42, therefore, the valve 43 closes the supply flow path 28.

Bubble Exhausting Routine

Next, the bubble exhausting method in the liquid discharging apparatus 11 will be described with reference to the bubble exhausting routine indicated in FIG. 3. The sequence of steps in each control method described below can be arbitrarily changed without departing from the object of the control method. The control portion 19 may execute the bubble exhausting routine at a time when the exhaust of a bubble is commanded. Alternatively, the control portion 19 may execute the bubble exhausting routine after the circulation flow path 26 is filled with a liquid or after the liquid discharging apparatus 11 is powered on, for example. Alternatively, the control portion 19 may periodically execute the bubble exhausting routine.

Figure 3:
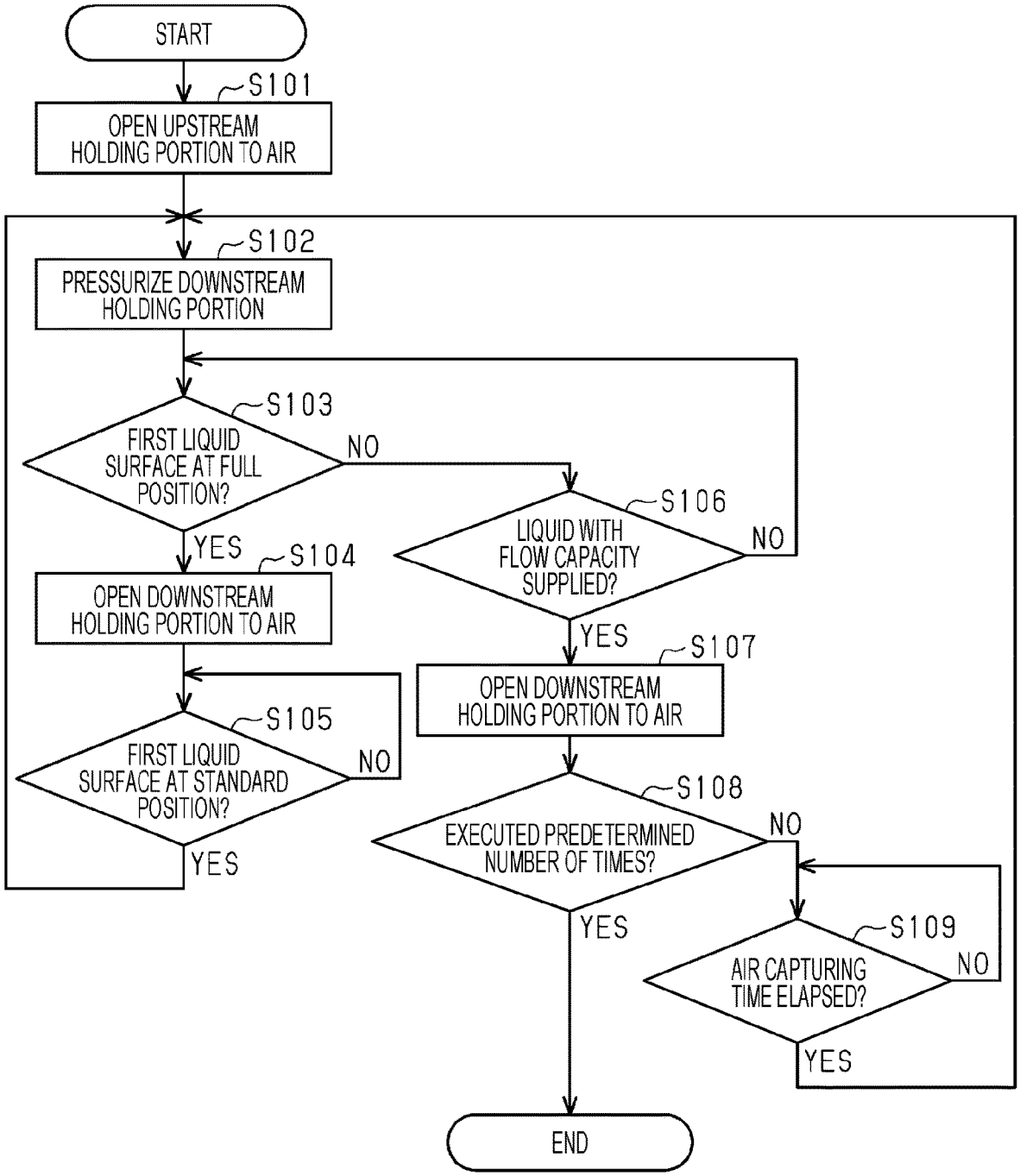
FIG. 3 is a flowchart indicating an example of a bubble exhausting routine in the first embodiment.

As illustrated in FIG. 3, the control portion 19 opens the upstream storing portion 41 to the air in step S101. The control portion 19 then causes the air pressurizing portion 48 to pressurize the interior of the downstream storing portion 42 in step S102.

In step S103, the control portion 19 decides whether the first liquid surface 66 is at the full position. When the first liquid surface 66 is not at the full position, step S103 produces a NO result, in which case the control portion 19 causes the process to proceed to step S106. When the first liquid surface 66 is at the full position, step S103 produces a YES result, in which case the control portion 19 causes the process to proceed to step S104. In step S104, the control portion 19 drives the reverse rotation of the air pressurizing portion 48 to open the downstream storing portion 42 to the air.

In step S105, the control portion 19 decides whether the first liquid surface 66 has dropped to the standard position. When the first liquid surface 66 is not at the standard position, step S105 produces a NO result, in which case the control portion 19 waits until the first liquid surface 66 drops to the standard position. When the first liquid surface 66 is at the standard position, step S105 produces a YES result, in which case the control portion 19 causes the process to return to step S102.

In step S106, the control portion 19 decides whether a liquid with a flow capacity has been supplied from the downstream storing portion 42. When the volume of the liquid supplied from the downstream storing portion 42 is less than the flow capacity, step S106 produces a NO result, in which case the control portion 19 causes the process to return to step S103. When a liquid with the flow capacity has been supplied from the downstream storing portion 42, step S106 produces a YES result, in which case the control portion 19 causes the process to proceed to step S107.

In step S107, the control portion 19 drives the reverse rotation of the air pressurizing portion 48 to open the downstream storing portion 42 to the air. In step S108, the control portion 19 decides whether the downstream storing portion 42 has been pressurized a predetermined number of times. The predetermined number of times is, for example, one more than the number of air capturing portions 45. In this embodiment, the liquid circulating device 24 has one air capturing portion 45, so the predetermined number of times is 2. When the number of times the downstream storing portion 42 has been pressurized is less than the predetermined number of times, step S108 produces a NO result, in which case the control portion 19 causes the process to proceed to step S109.

In step S109, the control portion 19 decides whether an air capturing time has elapsed from when the downstream storing portion 42 was opened to the air. When the air capturing time has not elapsed, step S109 produces a NO result, in which case the control portion 19 waits until the air capturing time elapses. When the air capturing time has elapsed, step S109 produces a YES result, in which case the control portion 19 causes the process to return to step S102.

In step S108, when the number of times the downstream storing portion 42 has been pressurized after the start of the bubble exhausting routine reaches the predetermined number of times, step S108 produces a YES result, in which case the control portion 19 terminates the bubble exhausting routine.

Next, functions in the exhausting of bubbles will be described.

As illustrated in FIG. 3, the liquid circulating device 24 executes a first flow process, a wait process, and a second flow process in that order to exhaust bubbles from the circulation flow path 26. Specifically, the liquid circulating device 24 executes steps S102, S106, and S107 as the first flow process and second flow process, after which the liquid circulating device 24 executes step S109 as the wait process.

In the first flow process, the liquid is caused to flow by the liquid flowing portion 27 until bubbles present in the liquid ejecting head 23 reach the rising flow path 45*a* or falling flow path 45*b*, as illustrated in FIG. 2. Specifically, in the liquid circulating device 24, the air pressurizing portion 48 pressurizes the interior of the downstream storing portion 42 to extrude the liquid in the downstream storing portion 42 so that the liquid flows in the circulation direction D. At this time, the interior of the upstream storing portion 41 is open to the air. Therefore, the pressure in the downstream storing portion 42 is higher than the pressure in the upstream storing portion 41, so the valve 43 is closed.

An volume by which the liquid flows in the first flow process may be less than the volume of air, the volume being obtained by subtracting the volume of liquid held in the upstream storing portion 41 from the maximum volume to which the liquid can be held in the upstream storing portion 41. The maximum volume to which the liquid can be held in the upstream storing portion 41 is the volume of liquid held in the upstream storing portion 41 when the first liquid surface 66 is at the full position. Therefore, the volume of air is an volume by which the upstream storing portion 41 can accept the liquid. When the liquid flows in the first flow process by an volume less than the volume of air, the position of the first liquid surface 66 at the termination of the first flow process is below the full position.

An volume by which the liquid flows in the first flow process may be less than the volume of liquid held in the downstream storing portion 42 before the first flow process starts. The valve 43 in this embodiment is opened when the pressure in the downstream storing portion 42 is higher than the pressure in the upstream storing portion 41. While the first flow process is in progress, therefore, the supply of the liquid from the upstream storing portion 41 to the downstream storing portion 42 is stopped. Therefore, when the volume of liquid to be supplied from the downstream storing portion 42 in the first flow process is reduced below the volume of liquid to be held in the downstream storing portion 42, the supply of the liquid to the downstream storing portion 42 in the first flow process can be eliminated.

The volume of liquid flowing in the first flow process may be greater than the volume of the flow path from the liquid ejecting head 23 to the air capturing portion 45. Thus, the bubbles gathered in the liquid ejecting head 23 are fed to the air capturing portion 45.

In the wait process, a wait is made for a time equal to the air capturing time in a state in which the flow of the liquid is stopped. The air capturing time is, for example, the time taken from when bubbles present in the rising flow path 45*a* and falling flow path 45*b* move due to the buoyant forces of the bubbles until the bubbles gather at an intermediate position between the rising flow path 45*a* and the falling flow path 45*b*. Specifically, the air capturing time is from about several seconds to about several tens of seconds. The air capturing time may be set in advance or may be set according to the lengths of the rising flow path 45*a* and falling flow path 45*b*, the magnitudes of their inclinations, temperature in the environment in which the liquid discharging apparatus 11 is mounted, the temperature of the liquid, and other factors. When temperature in the environment and the temperature of the liquid are high, for example, the viscosity of the liquid is lowered and the sizes of bubbles become large. This makes the bubbles easy to move. In view of this, the shorter the lengths of the rising flow path 45*a* and falling flow path 45*b* are, the larger their inclinations are, and the higher temperature in the environment and the temperature of the liquid are, the shorter the air capturing time may be.

In the wait process, the downstream storing portion 42 is open to the air. Therefore, the interior of the upstream storing portion 41 and the interior of the downstream storing portion 42 are at the atmospheric pressure, opening the valve 43. When the first flow process is terminates and the wait process starts, the first liquid surface 66 is above the second liquid surface 70. The liquid in the upstream storing portion 41 is supplied to the downstream storing portion 42 due to the difference between the head of the liquid in the upstream storing portion 41 and that in the downstream storing portion 42. In the wait process, the first liquid surface 66 drops and the second liquid surface 70 rises.

In the second flow process, the liquid is caused to flow by the liquid flowing portion 27 until the bubbles captured in the air capturing portion 45 are fed to the supply flow path 28. The volume of liquid flowing in the second flow process may be greater than the volume of the flow path from the air capturing portion 45 to the upstream storing portion 41. Thus, the bubbles gathered in the air capturing portion 45 are fed to the supply flow path 28.

The same volume of liquid may flow in the first flow process and in the second flow process. The volume of liquid flowing in the first flow process and that in the second flow process may be greater than the volume of the flow path from the liquid ejecting head 23 to the air capturing portion 45 or the volume of the flow path from the air capturing portion 45 to the upstream storing portion 41, whichever is greater.

When, for example, the air capturing time is shorter than the time taken by the first liquid surface 66 to drop to the standard position in the wait process, there is a case in which the first liquid surface 66 is above the standard position at the start of the second flow process. There is the fear that when the second flow process is executed in this state, the first liquid surface 66 reaches the full position before the bubbles captured in the air capturing portion 45 are fed to the upstream storing portion 41. In this case, the control portion 19 may discontinue the second flow process and then may open the downstream storing portion 42 to the air. The control portion 19 may wait until the first liquid surface 66 reaches the standard position, after which the control portion 19 may perform the second flow process.

Effects in this embodiment will be described.

1. The liquid flowing portion 27 causes a liquid to flow in the circulation flow path 26 that includes the supply flow path 28, liquid ejecting head 23, and collection flow path 29. Since the air capturing portion 45 is disposed at a position above the liquid ejecting head 23, the buoyant forces of bubbles can be used to capture the bubbles. The air capturing portion 45 is provided in at least one of the supply flow path 28 and collection flow path 29. The liquid flowing portion 27 can suppress bubbles from gathering in the liquid ejecting head 23 by causing the bubbles to flow to the air capturing portion 45. This makes it possible to stop circulation in the middle. Therefore, bubbles can be exhausted due to circulation without having to provide a plurality of liquid flowing portions 27.

2. The air capturing portion 45 may be composed of the turnaround portion CF provided in a flow path. The turnaround portion CF may be composed of the rising flow path 45*a* through which the liquid rises and the falling flow path 45*b* through which the liquid falls. The falling flow path 45*b* may be disposed downstream of the rising flow path 45*a* in the circulation direction D.

In this structure, the air capturing portion 45 is composed of the turnaround portion CF. The turnaround portion CF is composed of the rising flow path 45*a* through which the liquid rises and the falling flow path 45*b* through which the liquid falls, the falling flow path 45*b* being disposed downstream of the rising flow path 45*a* in the circulation direction D. Bubbles moves upward due to their buoyant forces. Therefore, the air capturing portion 45 can gather bubbles in the rising flow path 45*a* and bubbles in the falling flow path 45*b* at an intermediate position between the rising flow path 45*a* and the falling flow path 45*b*. In the liquid circulating device 24, therefore, the air capturing portion 45 having a simple structure can be achieved.

3. The air capturing portion 45 may be disposed at the highest position in a flow path.

In this structure, the air capturing portion 45 can make bubbles easy to move to the air capturing portion 45 due to buoyant forces generated in the bubbles, and can more greatly suppress the bubbles from gathering in the liquid ejecting head 23 when circulation is stopped.

4. The air capturing portion 45 may be disposed in the collection flow path 29.

In this structure, the air capturing portion 45 captures bubbles at a position downstream of the liquid ejecting head 23 in the circulation direction D. This can suppress bubbles that have passed through the liquid ejecting head 23 from returning to the liquid ejecting head 23.

5. The supply flow path 28 may include the upstream storing portion 41 and downstream storing portion 42 that can hold a liquid. In the supply flow path 28, the downstream storing portion 42 may be disposed downstream of the upstream storing portion 41 in the circulation direction D. The collection flow path 29 may cause the liquid ejecting head 23 and upstream storing portion 41 to communicate with each other. In this structure, the liquid circulating device 24 can collect bubbles in the upstream storing portion 41.

6. An volume by which the liquid flowing portion 27 causes the liquid to flow at one time may be less than the volume of air, the volume being obtained by subtracting the volume of liquid held in the upstream storing portion 41 from the maximum volume to which the liquid can be held in the upstream storing portion 41. In this structure, an volume by which the liquid flowing portion 27 causes the liquid to flow at one time is less than the volume of air in the upstream storing portion 41. That is, the volume of liquid flowing into the upstream storing portion 41 while the liquid flowing portion 27 causes the liquid to flow is less than the volume of air. This can suppress the liquid from overflowing from the upstream storing portion 41.

7. An volume by which the liquid flowing portion 27 causes the liquid to flow at one time may be less than the volume of liquid held in the downstream storing portion 42.

There is the fear that when, for example, the liquid flowing portion 27 causes a liquid by an volume greater than the volume of liquid held in the downstream storing portion 42, air is supplied from the downstream storing portion 42. In this structure, however, since an volume by which the liquid flowing portion 27 causes the liquid to flow at one time is less than the volume of liquid held in the downstream storing portion 42, air can be made likely to stay in the downstream storing portion 42.

8. The valve 43 may be further provided in the supply flow path 28. The valve 43 may permit a flow of the liquid supplied from the upstream storing portion 41 to the downstream storing portion 42 but may restrict a flow of the liquid from the downstream storing portion 42 to the upstream storing portion 41. In this structure, the valve 43 permits a flow of the liquid from the upstream storing portion 41 to the downstream storing portion 42 but restricts a flow of the liquid from the downstream storing portion 42 to the upstream storing portion 41. This enables the liquid to be supplied from the upstream storing portion 41 to the downstream storing portion 42 and from the downstream storing portion 42 to the liquid ejecting head 23 under different pressures in the downstream storing portion 42.

9. An volume by which the liquid flowing portion 27 causes the liquid to flow at one time may be greater than the volume of the flow path from the liquid ejecting head 23 to the air capturing portion 45 or the volume of the flow path from the air capturing portion 45 to the supply flow path 28, whichever is greater. In this structure, the liquid flowing portion 27 causes the liquid to flow by an volume greater than the volume of the flow path from the liquid ejecting head 23 to the air capturing portion 45 or the volume of the flow path from the air capturing portion 45 to the supply flow path 28, whichever is greater. This can reduce the fear that bubbles stay between the liquid ejecting head 23 and the air capturing portion 45 or between the air capturing portion 45 and the supply flow path 28.

10. The liquid discharging apparatus 11 has a plurality of liquid circulating devices 24 described above and also has the liquid ejecting head 23 that discharges a liquid. The plurality of liquid circulating devices 24 share a single liquid flowing portion 27. The single liquid flowing portion 27 has the air pressurizing portion 48 that supplies air to a plurality of downstream storing portions 42 to pressurize the interiors of the downstream storing portions 42. The air pressurizing portion 48 can concurrently pressurize the interiors of the plurality of downstream storing portions 42. In this structure, the liquid flowing portion 27 has the air pressurizing portion 48. The air pressurizing portion 48 can concurrently pressurize the plurality of downstream storing portions 42. This enables each of the plurality of liquid circulating devices 24 to cause a liquid flow in the liquid circulating devices 24 by a single common liquid flowing portion 27. Therefore, the number of members can be made smaller than when each of the plurality of liquid circulating devices 24 has the liquid flowing portion 27.

11. In a bubble exhausting method in the liquid discharging apparatus 11, the liquid discharging apparatus 11 has the liquid ejecting head 23, liquid flowing portion 27, supply flow path 28, and collection flow path 29. The liquid ejecting head 23 discharges a liquid. The supply flow path 28 is used to supply the liquid from the liquid supply source 34 in which the liquid is stored to the liquid ejecting head 23. The collection flow path 29 is used to collect the liquid from the liquid ejecting head 23 and return the collected liquid to the supply flow path 28. The liquid flowing portion 27 causes the liquid to flow in the circulation flow path 26, which includes the supply flow path 28, liquid ejecting head 23, and collection flow path 29. The air capturing portion 45, which can capture bubbles, is provided in at least one of the supply flow path 28 and collection flow path 29. The air capturing portion 45 is composed of the turnaround portion CF disposed at a position, in the liquid flow path, higher than the liquid ejecting head 23. The turnaround portion CF is composed of the rising flow path 45*a* through which the liquid rises and the falling flow path 45*b* through which the liquid falls, the falling flow path 45*b* being disposed downstream of the rising flow path 45*a* in the circulation direction D. The bubble exhausting method in the liquid discharging apparatus 11 includes a first flow process, a wait process, and a second flow process. In the first flow process, the liquid is caused to flow by the liquid flowing portion 27 until bubbles present in the liquid ejecting head 23 reach the rising flow path 45*a* or falling flow path 45*b*. In the wait process, a wait is made for a time equal to the air capturing time in a state in which the flow of the liquid is stopped. In the second flow process, the liquid is caused to flow by the liquid flowing portion 27 until the bubbles captured in the air capturing portion 45 are fed to the supply flow path 28. In this method, effects similar to those in the liquid circulating device 24 can be obtained.

12. In the bubble exhausting method in the liquid discharging apparatus 11, the supply flow path 28 has the upstream storing portion 41 to which the collection flow path 29 is coupled and in which a liquid can be held, and also has the downstream storing portion 42 in which the liquid can be held, the downstream storing portion 42 being disposed downstream of the upstream storing portion 41 in the circulation direction D. An volume by which the liquid flows in each of the first flow process and second flow process may be less than the volume of air, the volume being obtained by subtracting the volume of liquid held in the upstream storing portion 41 from the maximum volume to which the liquid can be held in the upstream storing portion 41.

In this structure, an volume by which the liquid flowing portion 27 causes the liquid to flow at one time is less than the volume of air in the upstream storing portion 41. That is, the volume of liquid flowing into the upstream storing portion 41 while the liquid flowing portion 27 causes the liquid to flow is less than the volume of air. This can suppress the liquid from overflowing from the upstream storing portion 41.

13. An volume by which the liquid flows in each of the first flow process and second flow process may be less than the volume of liquid held in the downstream storing portion 42 before the flow process is started.

There is the fear that when, for example, the liquid flowing portion 27 causes a liquid by an volume greater than the volume of liquid held in the downstream storing portion 42, air is supplied from the downstream storing portion 42. In this structure, however, since an volume by which the liquid flowing portion 27 causes the liquid to flow at one time is less than the volume of liquid held in the downstream storing portion 42, air can be made likely to stay in the downstream storing portion 42.

14. An volume by which the liquid flows in each of the first flow process and second flow process may be greater than the volume of the flow path from the liquid ejecting head 23 to the air capturing portion 45 or the volume of the flow path from the air capturing portion 45 to the upstream storing portion 41, whichever is greater.

In this structure, the liquid flowing portion 27 causes the liquid to flow by an volume greater than the volume of the flow path from the liquid ejecting head 23 to the air capturing portion 45 or the volume of the flow path from the air capturing portion 45 to the supply flow path 28, whichever is greater. This can reduce the fear that bubbles stay between the liquid ejecting head 23 and the air capturing portion 45 or between the air capturing portion 45 and the supply flow path 28.

This embodiment can be modified as described below and can be practiced. This embodiment and variations described below can be combined within a range in which any contradiction does not occur from a technical viewpoint.

Figure 4:
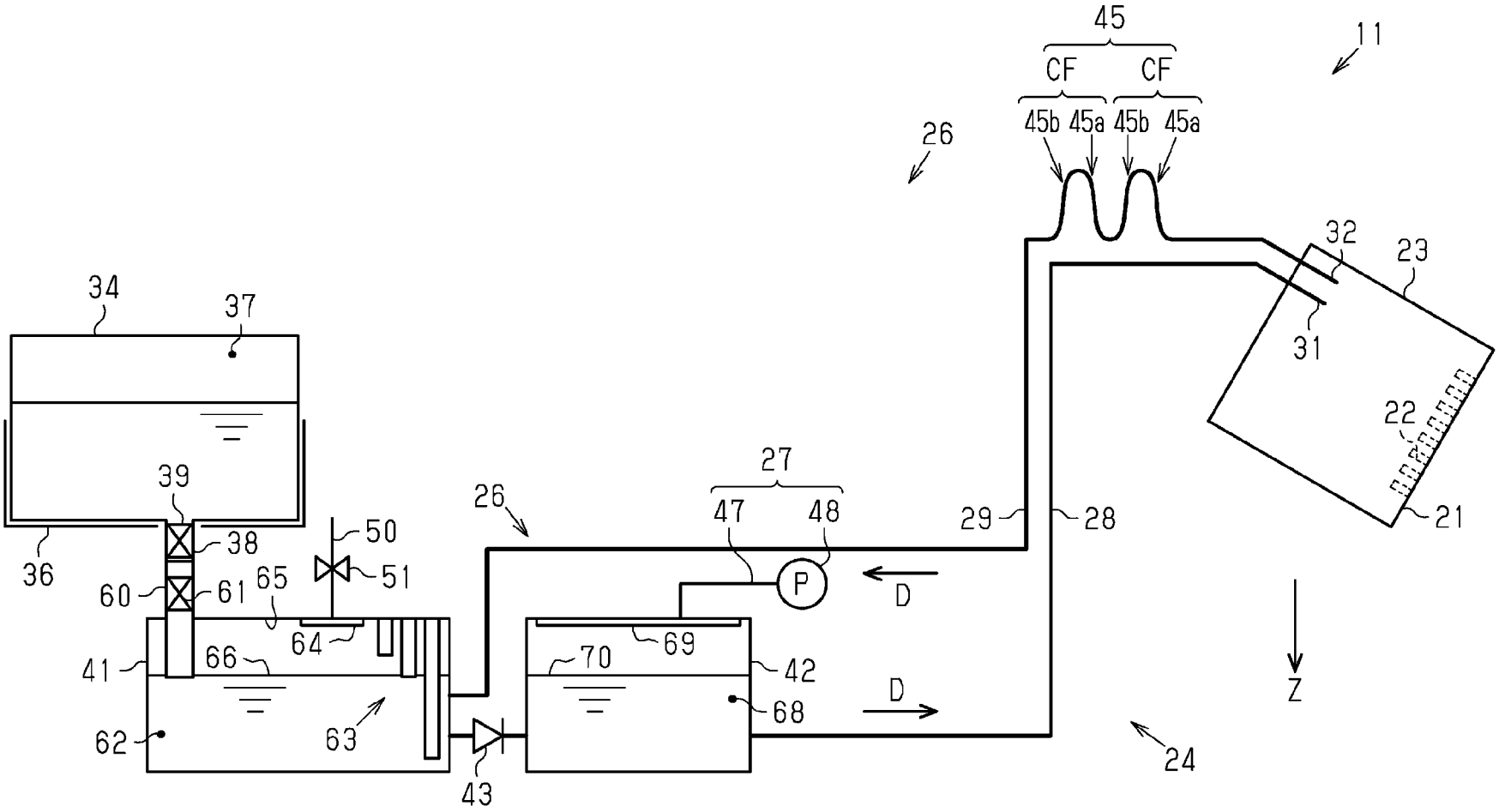
FIG. 4 illustrates another example of the air capturing portion.

The air capturing portion 45 may be composed of a plurality of turnaround portions CF as illustrated in FIG. 4. The air capturing portion 45 in FIG. 4 is composed of two turnaround portions CF. This enables the air capturing portion 45 to capture bubbles more efficiently than when the air capturing portion 45 is composed of a single turnaround portions CF.

The liquid discharging apparatus 11 may have only a single liquid circulating device 24 as illustrated in FIG. 4. The liquid discharging apparatus 11 may discharge ink in only a single color for monochrome printing, for example.

The liquid ejecting head 23 may be disposed in an inclined orientation in which the nozzle plane 21 is inclined with respect to a horizontal plane, as illustrated in FIG. 4. The liquid ejecting head 23 may execute printing by discharging a liquid to the medium 12 in the inclined orientation. The liquid ejecting head 23 may be provided so that it can switch between the inclined orientation and a horizontal orientation in which the nozzle plane 21 is horizontal. The first coupling portion 31 and second coupling portion 32 may be positioned so that one of them is positioned at a higher position than the other. The air capturing portion 45 may be disposed in a flow path coupled to the first coupling portion 31 or second coupling portion 32, whichever is at a higher position. For example, the second coupling portion 32 may be positioned at a higher position than the first coupling portion 31, and the air capturing portion 45 may be disposed in the collection flow path 29 coupled to the second coupling portion 32.

The air capturing time may be longer than the time taken by the first liquid surface 66 to drop from the full position to the standard position. The control portion 19 may execute the second flow process after the first liquid surface 66 has dropped to the standard position. That is, the control portion 19 may execute the second flow process in a state in which both the first liquid surface 66 and the second liquid surface 70 are at the standard position.

The liquid ejecting head 23 may have a plurality of pressure chambers that communicate with a plurality of nozzles 22 in one-to-one correspondence, a common liquid chamber with which the plurality of pressure chambers communicate, and a filter chamber in which a filter is stored. The first coupling portion 31 and second coupling portion 32 are coupled to at least one of the pressure chambers, common liquid chamber, and filter chamber. When, for example, the first coupling portion 31 and second coupling portion 32 are coupled to the filter chamber, the liquid discharging apparatus 11 can collect, in the upstream storing portion 41, bubbles captured by the filter due to a flow of the liquid, together with the liquid. When the bubbles are gathered in the liquid ejecting head 23, the liquid discharging apparatus 11 may exhaust the bubbles.

The liquid-level sensor 63 may detect that the first liquid surface 66 is at an end position below the standard position. When the liquid-level sensor 63 detects that the first liquid surface 66 is at the end position, the control portion 19 may submit a notification indicating that the upstream storing portion 41 is empty. With the first liquid surface 66 and second liquid surface 70 at the end position, when the sum of the volume of liquid held in the upstream storing portion 41 and the volume of liquid held in the downstream storing portion 42 is larger the volume of liquid needed for printing on a single medium 12, printing on the single medium 12 can be completed.

The upstream storing portion 41 and downstream storing portion 42 may be formed as a single portion.

The air pressurizing portion 48 may be a diaphragm pump, a piston pump, a gear pump, or the like.

The leading-in portion 60 and leading-out portion 38 may be separately provided. For example, one of the leading-in portion 60 and leading-out portion 38 may be used to cause the liquid to flow from the liquid supply source 34 to the upstream storing portion 41, and the other of them may be used to cause air to flow from the upstream storing portion 41 to the liquid supply source 34.

The liquid discharging apparatus 11 may have the atmosphere communication path 50, through which the downstream storing portion 42 is open to the air, separately from the pressuring flow path 47.

Each of the plurality of liquid circulating devices 24 may individually have the liquid flowing portion 27.

The liquid flowing portion 27 may have a plurality of valves disposed in the pressuring flow path 47. The plurality of valves may be disposed in one-to-one correspondence with the plurality of downstream storing portions 42. The control portion 19 may individually pressurize the interiors of the downstream storing portion 42 by controlling the driving of the plurality of valves and the air pressurizing portion 48.

The valve 43 may be opened and closed under control of the control portion 19. The control portion 19 may close the valve 43 when the liquid flowing portion 27 is to pressurize the interior of the downstream storing portion 42, and may open the valve 43 when the liquid is to be supplied from the upstream storing portion 41 to the downstream storing portion 42.

An volume by which the liquid flowing portion 27 causes the liquid to flow at one time may be less than or equal to the volume of the flow path from the liquid ejecting head 23 to the air capturing portion 45 or the volume of the flow path from the air capturing portion 45 to the supply flow path 28, whichever is greater. There is the fear that when, for example, an volume by which the liquid flowing portion 27 causes the liquid to flow at one time is less than or equal to the volume of the flow path from the liquid ejecting head 23 to the air capturing portion 45, bubbles fed from the liquid ejecting head 23 do not reach the air capturing portion 45. In this case, the air capturing time may be prolonged to wait until the bubbles move to the air capturing portion 45 due to their buoyant forces. In another example, there is the fear that when an volume by which the liquid flowing portion 27 causes the liquid to flow at one time is less than or equal to the volume of the flow path from the air capturing portion 45 to the supply flow path 28, bubbles fed from the air capturing portion 45 do not reach the supply flow path 28. In this case, a part of the circulation flow path 26, the part being downstream of the position that bubbles reach in the circulation direction D, may be disposed at a position higher than the position that bubbles reach so that the bubbles move to the supply flow path 28 due to their buoyant forces.

An volume by which the liquid flowing portion 27 causes the liquid to flow at one time may be greater than or equal to the volume of liquid held in the downstream storing portion 42. For example, the liquid flowing portion 27 may supply the liquid to the downstream storing portion 42 to cause the liquid in the circulation flow path 26 to flow. An volume by which the liquid flowing portion 27 causes the liquid to flow at one time may be greater than or equal to the volume of air in the upstream storing portion 41. The liquid flowing portion 27 may be a pump disposed at a position in the supply flow path 28 between the upstream storing portion 41 and the downstream storing portion 42, the pump supplying the liquid from the upstream storing portion 41 to the downstream storing portion 42.

The collection flow path 29 may be coupled at any position different from the position of the upstream storing portion 41 as long as the different position is included in the supply flow path 28 and is upstream of the valve 43 in the circulation direction D.

The air capturing portion 45 may be disposed in the supply flow path 28 as long as the air capturing portion 45 is disposed at a position higher than the position of the liquid ejecting head 23. Specifically, in the supply flow path 28, the air capturing portion 45 may be disposed at a position higher than the position of the first coupling portion 31. When the air capturing portion 45 is disposed in the supply flow path 28, the liquid flowing portion 27 may cause the liquid to flow at one time by an volume greater than the volume of the circulation flow path 26 from the downstream storing portion 42 to the air capturing portion 45 or the volume of the circulation flow path 26 from the air capturing portion 45 to the upstream storing portion 41, whichever is greater.

The liquid circulating device 24 may have a plurality of air capturing portions 45. The plurality of air capturing portions 45 may be disposed in the collection flow path 29, may be disposed in the supply flow path 28, or may be disposed in both the supply flow path 28 and the collection flow path 29. When the liquid circulating device 24 has a plurality of air capturing portions 45, in the bubble exhausting method, the second flow process may be suspended and the wait process may then be performed. When, for example, the liquid circulating device 24 has one air capturing portion 45 disposed in the supply flow path 28 and one air capturing portion 45 disposed in the collection flow path 29, bubbles may be fed to the air capturing portion 45 disposed in the supply flow path 28 in the first flow process, after which a wait may be made by the air capturing time so that bubbles are gathered in this air capturing portion 45. In the second flow process, the bubbles gathered in the air capturing portion 45 disposed in the supply flow path 28 may be fed to the air capturing portion 45 disposed in the collection flow path 29, after which a wait may be made by the air capturing time, and the bubbles may then be fed to the upstream storing portion 41.

The air capturing portion 45 may be positioned at a position different from the highest position in the circulation flow path 26.

The air capturing portion 45 may have a filter that captures bubbles.

Bubbles includes not only a single mass of frothy air but also a plurality of integrally gathered masses of frothy air.

The liquid discharging apparatus 11 may eject or discharge a liquid other than inks. States of the liquid discharged from the liquid discharging apparatus 11 in the form of droplets in a very small volume include a granular state, a tear-like state, and a state tailing like a string. The liquid referred to here only needs to be a material that can be discharged from the liquid discharging apparatus 11. For example, the liquid may only need to be a material in a state in which the substance is in a liquid phase. Therefore, liquids include materials in a liquid state that have high viscosity or low viscosity and other materials in a fluid state such as inorganic solvents such as sols, gel water, and the like, organic solvents, solutions, liquid resins, metals in a liquid state, and metallic melts. Liquids also includes not only liquids, which are in one state of substances, but also solvents in which particles of a functional material composed of pigments, metal particles, or another solid are dissolved, dispersed, or mixed. Typical examples of liquids include liquid crystals and inks described in the above embodiment. Inks referred to here include ordinary water-based inks and oil-based inks as well as various types of liquid compositions such as gel inks and hot melt inks. Specific examples of the liquid discharging apparatus 11 include, for example, apparatuses that discharge a liquid in which a material, such as an electrode material or a color material, used in, for example, the manufacturing of a liquid crystal displays, an electroluminescence display, or a field emission display, is dispersed or dissolved. The liquid discharging apparatus 11 may be an apparatus that discharges a bio-organic substance used in the manufacturing of biochips, an apparatus that discharges a liquid that becomes a sample used as precise pipettes, a printer, a microdispenser, or the like. Alternatively, the liquid discharging apparatus 11 may be an apparatus that discharges a lubricant to a clock, a camera, or another precision machine at a particular point or an apparatus that discharges a transparent resin liquid such as an ultraviolet curable resin liquid to a substrate to form a minute hemispherical lens, an optical lens, or the like used in an optical communication element or the like. Alternatively, the liquid discharging apparatus 11 may be an apparatus that discharges an acidic or alkaline etching liquid to etch a substrate or the like.

A pressurizing mechanism, a pressurizing device, and a liquid discharging apparatus in a second to a fourth embodiment will be described with reference to the drawings. The liquid discharging apparatus is, for example, an ink jet printer that performs printing by discharging ink, which is an example of a liquid, to a medium such as a sheet.

Second Embodiment

Structure of the Liquid Discharging Apparatus 11

The liquid discharging apparatus 11 may have medium storage portions 13 that can store media 12, a stacker 14 that receives a medium 12 on which printing has been performed, and a manipulation portion 15, such as, for example, a touch panel, used to manipulate the liquid discharging apparatus 11, as illustrated in FIG. 1. The liquid discharging apparatus 11 may have an image read portion 16 that reads an image on an original and an automatic feeding portion 17 that feeds an original to the image read portion 16.

The liquid discharging apparatus 11 has a control portion 19 that controls various operations executed in the liquid discharging apparatus 11. The control portion 19 is, for example, a processing circuit including a computer and memories. The control portion 19 performs control according to programs stored in memories.

Figure 5:
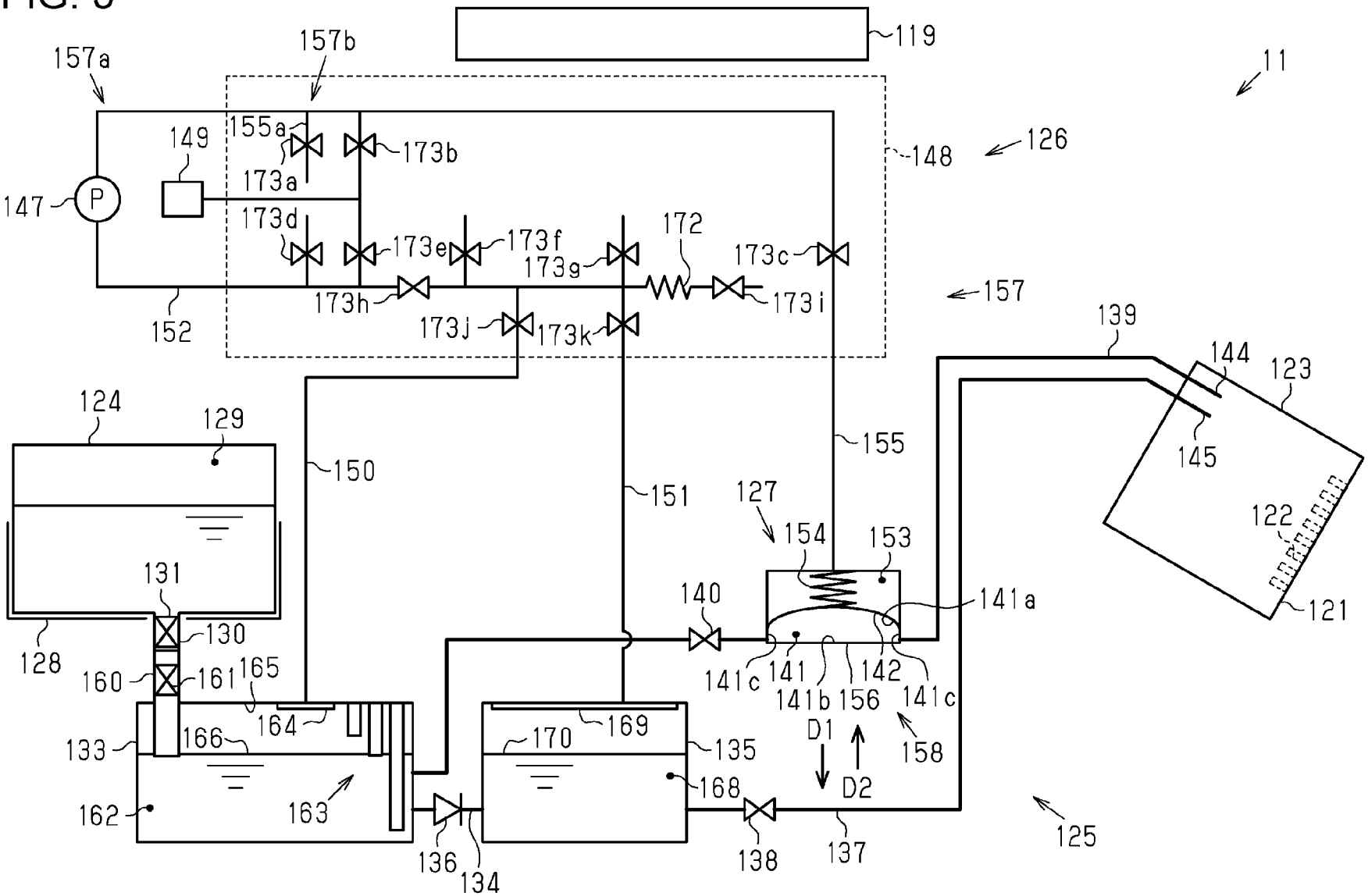
FIG. 5 is a schematic view illustrating the liquid discharging apparatus in the second embodiment.

As illustrated in FIG. 5, the liquid discharging apparatus 11 has a liquid ejecting head 123 that discharges a liquid from nozzles 122 formed in a nozzle plane 121, a supply mechanism 125 that supplies, to the liquid ejecting head 123, a liquid to be stored in a liquid storage portion 124, and a driving mechanism 126 that drives the supply mechanism 125. The liquid discharging apparatus 11 may have a plurality of supply mechanisms 125. Each of the plurality of supply mechanisms 125 may supply a different type of liquid to the liquid ejecting head 123. For example, the liquid discharging apparatus 11 may discharge inks in a plurality of colors supplied from the plurality of supply mechanisms 125 to perform color printing. A single driving mechanism 126 may drive all of the plurality of supply mechanisms 125 at one time. The liquid discharging apparatus 11 may have a plurality of driving mechanisms 126, each of which drives one of the plurality of supply mechanisms 125.

The liquid ejecting head 123 may be detachably mounted in the main body of the liquid discharging apparatus 11. The liquid ejecting head 123 is disposed in an inclined orientation in which the nozzle plane 121 is inclined with respect to a horizontal plane. The liquid ejecting head 123 may execute printing by discharging a liquid to the medium 12 in the inclined orientation. The liquid ejecting head 123 in the second embodiment is a line type head disposed across the width of the medium 12. However, the liquid ejecting head 123 may be a serial type head that performs printing while moving in the width direction of the medium 12.

The supply mechanism 125 may have volumeing portion 128 to which the liquid storage portion 124 is detachably attached. The liquid storage portion 124 may have a storage chamber 129 that stores a liquid, a leading-out portion 130 through which the liquid stored in the storage chamber 129 is led out, and a storage-portion-side valve 131 attached to the leading-out portion 130. The storage chamber 129 in the second embodiment is a sealed space that does not communicate with the air. Before the liquid storage portion 124 is mounted in the mounting portion 128, the liquid storage portion 124 may store a liquid by an volume greater than an volume by which the supply mechanism 125 can hold the liquid.

The supply mechanism 125 has a first holding portion 133 that stores the liquid supplied from the liquid storage portion 124, a communicating path 134, and a second holding portion 135. In the circulation direction D, the upstream end and downstream end of the communicating path 134 are respectively coupled to the first holding portion 133 and second holding portion 135. That is, the second holding portion 135 communicates with the first holding portion 133 through the communicating path 134. The supply mechanism 125 has a first valve 136 that can block the communicating path 134. The supply mechanism 125 has a supply flow path 137 through which the liquid is supplied from the second holding portion 135, which is an example of a liquid supply source, to the liquid ejecting head 123, as well as a second valve 138 disposed at a position in the supply flow path 137 between the second holding portion 135 and the liquid ejecting head 123. The supply mechanism 125 also has a collection flow path 139 through which the liquid that has not been used in the liquid ejecting head 123 is collected from the liquid ejecting head 123 into the first holding portion 133, which is an example of a liquid supply source, as well as a third valve 140 that can open and close the collection flow path 139. In addition, the supply mechanism 125 has a pressurizing mechanism 127.

The pressurizing mechanism 127 is disposed at some point in a liquid flow path through which the liquid flows. Specifically, the pressurizing mechanism 127 is disposed at some point in any one of the supply flow path 137 and collection flow path 139. In the second embodiment, the pressurizing mechanism 127 is disposed in the collection flow path 139, which is an example of a liquid flow path. The third valve 140 is a collection-side shut-off valve that can open and close the collection flow path 139. The third valve 140 is disposed in the collection flow path 139 so as to be closer to the first holding portion 133, which is an example of a liquid supply source, than is the pressurizing mechanism 127.

The pressurizing mechanism 127 has a base body 156, an elastic member 142 having flexibility, and an urging member 154. The base body 156 is part of the wall surfaces 141*a*, 141*b*, and 141*c* of a liquid chamber 141 communicating with the collection flow path 139. The elastic member 142 is disposed at a position at which the elastic member 142 faces the base body 156. The elastic member 142 is part of the wall surfaces 141*a*, 141*b*, and 141*c* of the liquid chamber 141. The elastic member 142 is displaced so as to increase or decrease the volume of the liquid chamber 141. The urging member 154 urges the elastic member 142 in a first direction D1, in which the volume of the liquid chamber 141 is reduced. The structure of the pressurizing mechanism 127 will be described later in detail.

The liquid ejecting head 123 may have a first coupling portion 144 to which the collection flow path 139 is coupled and a second coupling portion 145 to which the supply flow path 137 is coupled. In the direction in which the liquid flows, the upstream end and downstream end of the collection flow path 139 are respectively coupled to the first coupling portion 144 and the first holding portion 133. In the direction in which the liquid flows, the upstream end and downstream end of the supply flow path 137 are respectively coupled to the second holding portion 135 and the second coupling portion 145. In an inclined orientation, the first coupling portion 144 between the liquid ejecting head 123 and the collection flow path 139 may be disposed at a position higher than the position of the second coupling portion 145 between the liquid ejecting head 123 and the supply flow path 137.

The driving mechanism 126 has a pressurizing portion 147 that pressurizes the interior of the second holding portion 135. The driving mechanism 126 may have a switching mechanism 148 coupled to the pressurizing portion 147 and a pressure sensor 149 that detects pressure. The driving mechanism 126 may have an atmosphere communication path 150 coupled to the first holding portion 133, a pressurizing flow path 151 coupled to the second holding portion 135, and a coupling flow path 152 through which the atmosphere communication path 150 and pressurizing flow path 151 are coupled to the pressurizing portion 147.

The pressurizing portion 147 is, for example, a tube pump that feeds air while a roller rotates and crushes a tube. An air flow path 155 is coupled to one end of the tube (not illustrated) in the pressurizing portion 147, and the coupling flow path 152 is coupled to the other end of the tube. When the normal rotation of the pressurizing portion 147 is driven, the pressurizing portion 147 inhales air from the air flow path 155 and feeds the inhaled air to the coupling flow path 152. When the reverse rotation of the pressurizing portion 147 is driven, the pressurizing portion 147 inhales air from the coupling flow path 152 and feeds the inhaled air to the air flow path 155.

The liquid discharging apparatus 11 has a displacing device 157 that displaces the elastic member 142. The displacing device 157 includes a depressurizing device 157*a* that can depressurize the interior of a space 153 and an atmosphere release device 157*b* that can make the interior of the space 153 open to the air. The depressurizing device 157*a* and atmosphere release device 157*b* are driven by the control portion 19. The depressurizing device 157*a* includes the pressurizing portion 147. The atmosphere release device 157*b* includes an atmosphere communication path 155*a* and a first selection valve 173*a*, which is an atmosphere release valve.

The control portion 19 drives the depressurizing device 157*a* included in the displacing device 157. When a third selection valve 173*c* and a fourth selection valve 173*d*, are opened and the pressurizing portion 147 is then rotated normally, air is inhaled from the air flow path 155 and is fed to the coupling flow path 152, depressurizing the interior of the space 153. In the pressurizing mechanism 127, therefore, the elastic member 142 is displaced in a second direction D2, in which the volume of the liquid chamber 141 is increased, against the urging force of the urging member 154. In other words, the displacing device 157 displaces the elastic member 142 in the direction in which the volume of the liquid chamber 141 is increased against the urging force of the urging member 154 included in the pressurizing mechanism 127. That is, by driving the displacing device 157, the control portion 19 displaces the elastic member 142 in the direction in which the volume of the liquid chamber 141 is increased against the urging force of the urging member 154.

The control portion 19 stops the driving of the depressurizing device 157*a*. The pressurizing portion 147 is stopped and the fourth selection valve 173*d* is closed. At that time, the control portion 19 drives the atmosphere release device 157*b*. When the first selection valve 173*a*, which is an atmosphere release valve, is opened and the interior of the space 153 is then released to the air through the air flow path 155, a drag against the urging force of the urging member 154 is eliminated. Thus, in the pressurizing mechanism 127, the urging force of the urging member 154 is exerted on the elastic member 142 again and the urging force of the urging member 154 displaces the elastic member 142 in the first direction D1, in which the volume of the liquid chamber 141 is reduced. This places the liquid chamber 141 in a pressurized state. That is, to place the liquid chamber 141 in the pressurized state, the control portion 19 exerts the urging force of the urging member 154 on the elastic member 142 by eliminating the drag against the urging force. In other words, to place the liquid chamber 141 in the pressurized state, the control portion 19 exerts the urging force of the urging member 154 on the elastic member 142 by stopping the driving of the depressurizing device 157*a* and driving the atmosphere release device 157*b* to make the interior of the space 153 open to the air.

A pressurizing device 158 is formed by adding the displacing device 157 to the pressurizing mechanism 127. In the pressurizing device 158, the control portion 19 pressurizes the liquid in the collection flow path 139 by driving the displacing device 157 and performing control so that the drag against the urging force in the pressurizing mechanism 127 is exerted or eliminated.

Next, the first holding portion 133 will be described.

The first holding portion 133 has a leading-in portion 160 into which the liquid stored in the liquid storage portion 124 mounted in the mounting portion 128 can be led. The first holding portion 133 may have a device-side valve 161 attached to the leading-in portion 160, a first holding chamber 162 that holds a liquid, a liquid-level sensor 163 that detects the volume of liquid held in the first holding chamber 162, and a first gas-liquid separating film 164 that separates the first holding chamber 162 and atmosphere communication path 150 from each other. The first gas-liquid separating film 164 has the property that a gas passes through the first gas-liquid separating film 164 but a liquid does not pass through the first gas-liquid separating film 164.

The storage-portion-side valve 131 and device-side valve 161 are opened when the liquid storage portion 124 is mounted in the mounting portion 128, and keep the open state while the liquid storage portion 124 is mounted in the mounting portion 128. During the mounting of the liquid storage portion 124 in the mounting portion 128, when an arrangement is made so that the device-side valve 161 is opened earlier than the storage-portion-side valve 131, the fear that the liquid leaks from the liquid storage portion 124 can be reduced.

The leading-in portion 160 is disposed in the upper part of the first holding portion 133. The leading-in portion 160 in the second embodiment passes through the ceiling 165 of the first holding chamber 162. The lower end of the leading-in portion 160 is positioned in the first holding chamber 162 and thereby below the ceiling 165. The upper end of the leading-in portion 160 is positioned outside the first holding chamber 162 and thereby above the ceiling 165. When the liquid storage portion 124 is mounted in the mounting portion 128, the leading-in portion 160 is coupled to the leading-out portion 130 of the liquid storage portion 124.

The lower end of the leading-in portion 160 is positioned below the nozzle plane 121. Therefore, the first liquid surface 166 of the liquid held in the first holding portion 133 varies within a range lower than the nozzle plane 121. Specifically, the liquid in the liquid storage portion 124 is supplied to the first holding portion 133 through the leading-out portion 130 and leading-in portion 160, due to the head of the liquid in the liquid storage portion 124. Air is led from the first holding portion 133 through the leading-in portion 160 and leading-out portion 130 into the liquid storage portion 124 by an volume equal to the volume of liquid supplied to the first holding portion 133. The first liquid surface 166 is raised by an volume equal to the volume of supplied liquid. When the first liquid surface 166 reaches the lower end of the leading-in portion 160, the flow-in of air from the first holding portion 133 into the liquid storage portion 124 is restricted.

Since the storage chamber 129 is sealed, when the flow-in of air is restricted, the pressure in the storage chamber 129 is reduced by an volume equal to the volume of supplied liquid. When the negative pressure in the storage chamber 129 exceeds the head of the liquid in the storage chamber 129, the supply of the liquid from the liquid storage portion 124 to the first holding portion 133 is restricted.

When the liquid is supplied from the first holding portion 133 to the second holding portion 135, the first liquid surface 166 drops. When the first liquid surface 166 drops and air thereby flows into the storage chamber 129 through the leading-in portion 160 and leading-out portion 130, the negative pressure in the storage chamber 129 is reduced. The negative pressure in the storage chamber 129 becomes lower than the head of the liquid in the storage chamber 129, the liquid is supplied from the liquid storage portion 124 to the first holding portion 133. Therefore, while the liquid is stored in the liquid storage portion 124, the first liquid surface 166 is maintained at the standard position in the vicinity of the lower end of the leading-in portion 160. When there is no more liquid in the liquid storage portion 124, the first liquid surface 166 drops below the standard position.

The liquid-level sensor 163 may detect that the first liquid surface 166 is at the standard position, the first liquid surface 166 is below the standard position, and the first liquid surface 166 is at the full position, which is above the standard position. When the first liquid surface 166 is at the full position, the first holding portion 133 holds the maximum volume of liquid. When the liquid-level sensor 163 detects that the first liquid surface 166 is below the standard position, the control portion 19 may decide that the liquid storage portion 124 has become empty and may command the user to replace the liquid storage portion 124.

The standard position in the second embodiment is above the position at which the downstream end of the collection flow path 139 is coupled in the first holding chamber 162. When the first liquid surface 166 is at the standard position, therefore, the liquid in the first holding portion 133 can be supplied to the liquid ejecting head 123 through the collection flow path 139.

Next, the second holding portion 135 will be described.

The second holding portion 135 may have a second holding chamber 168 that holds a liquid as well as a second gas-liquid separating film 169 that separates the second holding chamber 168 and pressurizing flow path 151 from each other. The second gas-liquid separating film 169 has the property that a gas passes through the second gas-liquid separating film 169 but a liquid does not pass through the second gas-liquid separating film 169 as with the first gas-liquid separating film 164.

The liquid in the first holding portion 133 is supplied to the second holding portion 135 due to the difference between the head of the liquid in the first holding portion 133 and that in the second holding portion 135. The first valve 136 may have a check valve that permits a flow of the liquid from the first holding portion 133 to the second holding portion 135 but restricts a flow of the liquid from the second holding portion 135 to the first holding portion 133. When the interior of the first holding chamber 162 and the interior of the second holding chamber 168 are at the atmospheric pressure, the second liquid surface 170 of the liquid in the second holding portion 135 is at the same height as the first liquid surface 166. In other words, the second liquid surface 170 is maintained at the standard position, which is substantially at the same height as the lower end of the leading-in portion 160, and varies within a range lower than the nozzle plane 121. The liquid in the liquid ejecting head 123 is maintained at a negative pressure due to the difference between the head of the liquid in the first holding portion 133 and that in the second holding portion 135. When the liquid in the liquid ejecting head 123 is consumed, the liquid held in the second holding portion 135 is supplied to the liquid ejecting head 123.

When the pressure in the second holding portion 135 is higher than the pressure in the first holding portion 133, the first valve 136 closes the communicating path 134. When the pressurizing portion 147 is to pressurize the interior of the second holding portion 135, therefore, the first valve 136 closes the communicating path 134.

The opening and closing of the second valve 138 and third valve 140 are controlled by the control portion 19. The second valve 138 is provided so that it can open and close the supply flow path 137 at the time of pressurization by the pressurizing portion 147. The third valve 140 is provided so that it can open and close the collection flow path 139.

Next, the switching mechanism 148 will be described.

The switching mechanism 148 has a tubule portion 172 disposed in the coupling flow path 152 as well as first to eleventh selection valves 173*a* to 173*k* that can open and close flow paths. The tubule portion 172 is a meandering tube that is thin enough to greatly restrict the flow of a liquid when compared with a flow of air.

When the first selection valve 173*a* is opened, it causes the air flow path 155 to communicate with the air. When the second selection valve 173*b* is opened, it causes the air flow path 155 and pressure sensor 149 to communicate with the air. When the third selection valve 173*c* is opened, it opens the air flow path 155 and causes the pressurizing portion 147 and space 153 to communicate with each other.

When the fourth selection valve 173*d* is opened, it causes the coupling flow path 152 between the pressurizing portion 147 and the eighth selection valve 173*h* to communicate with the air. When the fifth selection valve 173*e* is opened, it causes the coupling flow path 152 and pressure sensor 149 to communicate with each other. When the sixth selection valve 173*f* is opened, it causes the coupling flow path 152 to communicate with the air. When the seventh selection valve 173*g* is opened, it causes the coupling flow path 152 to communicate with the air. When the eighth selection valve 173*h* is opened, it opens the coupling flow path 152. When the ninth selection valve 173*i* is opened, it causes the tubule portion 172 to communicate with the air. When the tenth selection valve 173*j* is opened, it opens the atmosphere communication path 150 and causes the first holding portion 133 and coupling flow path 152 to communicate with each other. When the eleventh selection valve 173*k* is opened, it opens the pressurizing flow path 151 and causes the second holding portion 135 and coupling flow path 152 to communicate with each other.

The pressurizing device 158 in the second embodiment may operate as a finely pressurizing portion that pressurizes the liquid in the supply flow path 137 by finely adjusting the pressure in the space 153. When the pressure in the space 153 is to be changed, the switching mechanism 148 opens the second selection valve 173*b* to the fourth selection valve 173*d* and closes the remaining selection valves. When the normal rotation of the pressurizing portion 147 is driven in this state, air in the space 153 is exhausted through the air flow path 155 and coupling flow path 152, reducing the pressure in the space 153. When the reverse rotation of the pressurizing portion 147 is driven in that state, air is fed to the space 153 through the coupling flow path 152 and air flow path 155, raising the pressure in the space 153. At this time, the pressure sensor 149 may detect the pressure in the air flow path 155 and space 153. The control portion 19 may control the driving of the pressurizing portion 147 in response to the result of detection by the pressure sensor 149.

When the first holding portion 133 is to be opened to the air, the switching mechanism 148 opens the sixth selection valve 173*f* and tenth selection valve 173*j*. Then, the first holding chamber 162 communicates with the air through the atmosphere communication path 150 and coupling flow path 152.

When the second holding portion 135 is to be opened to the air, the switching mechanism 148 opens the seventh selection valve 173*g* and eleventh selection valve 173*k*. Then, the second holding chamber 168 communicates with the air through the pressurizing flow path 151 and coupling flow path 152.

When the interior of the second holding portion 135 is to be pressurized, the switching mechanism 148 opens the first selection valve 173*a*, fifth selection valve 173*e*, eighth selection valve 173*h*, and eleventh selection valve 173*k* and closes the remaining selection valves. When the normal rotation of the pressurizing portion 147 is driven in this state, air flows into the second holding chamber 168 through the air flow path 155, coupling flow path 152, and pressurizing flow path 151, raising the pressure in the second holding chamber 168. At this time, the pressure sensor 149 may detect the pressure in the coupling flow path 152, pressurizing flow path 151, and second holding chamber 168. The control portion 19 may control the driving of the pressurizing portion 147 in response to the result of detection by the pressure sensor 149.

Structure of the Pressurizing Mechanism 127

Figure 6:
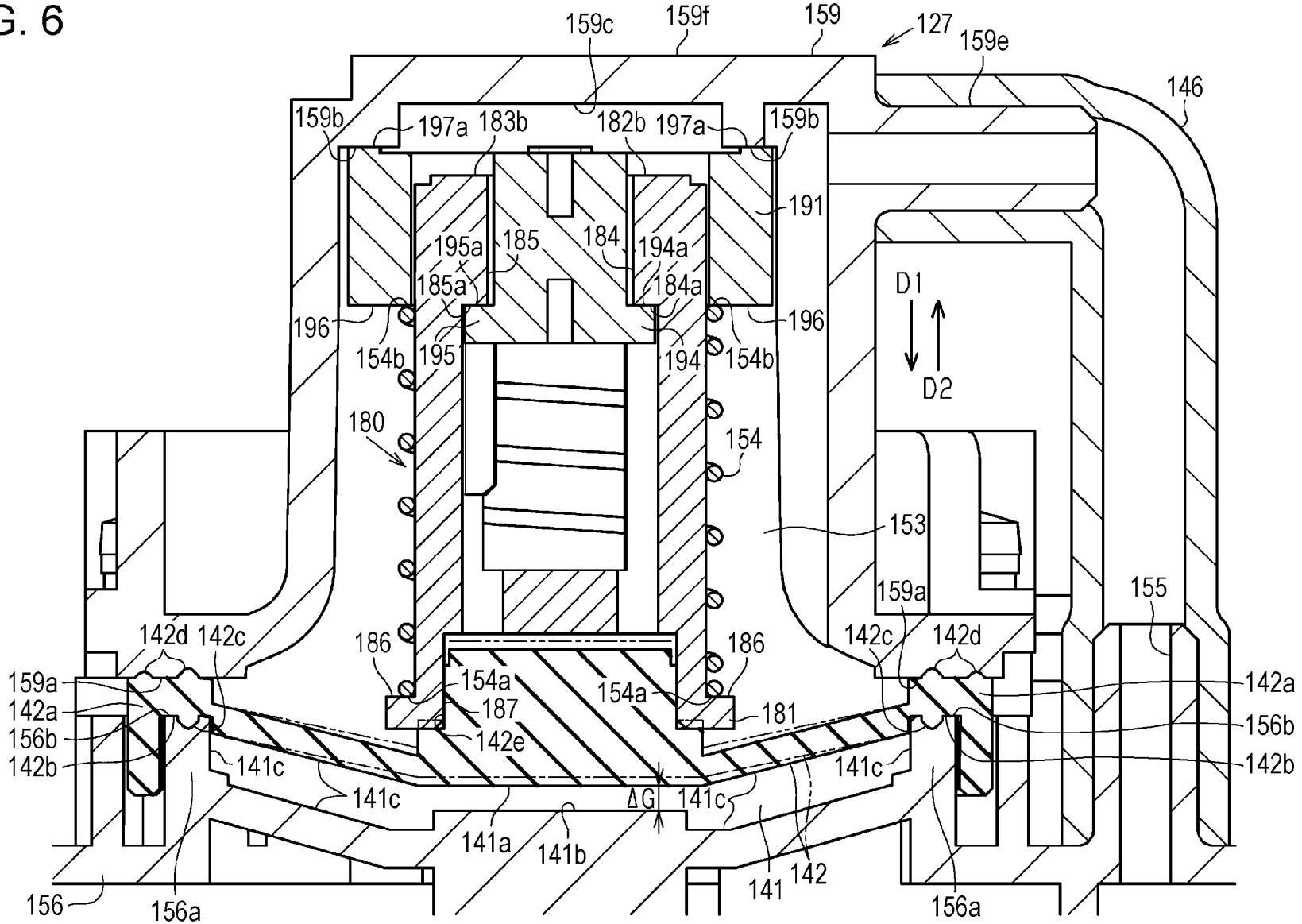
FIG. 6 is a side sectional view of a pressurizing mechanism in the second and third embodiments.

The pressurizing mechanism 127 has the base body 156, the elastic member 142, and a lid member 159 as illustrated in FIG. 6. The base body 156 has a support portion 156*b* along the outer circumference 156*a* of the liquid chamber 141 as a restricting member in a circumferential and convex shape. The elastic member 142, the outer shape of which is discal, has an outer edge 142*a*. The elastic member 142 further has a concave portion 142*b* having a circumferential and concave shape along the outer edge 142*a*. When the support portion 156*b* in a convex shape and the concave portion 142*b* in a concave shape are engaged with each other, the liquid chamber 141 is formed. The support portion 156*b* supports the outer edge 142*a* of the elastic member 142, and restricts the displacement of the elastic member 142 in the first direction D1, in which the volume of the liquid chamber 141 is reduced. Also, when the support portion 156*b* used as a restricting member in a convex shape and the concave portion 142*b* in a concave shape are engaged with each other, it is possible to suppress the position of the elastic member 142 from shifting in directions orthogonal to the first direction D1 with respect to the base body 156 due to a change in the volume of the liquid chamber 141. In this state, the lid member 159 presses the elastic member 142 against the base body 156 in the first direction D1 and is fixed. The lid member 159 is disposed opposite to the liquid chamber 141 with respect to the elastic member 142, and forms the space 153 outside the liquid chamber 141.

At the outer edge 142*a* of the elastic member 142, a seal support portion 142*c* in a circumferential shape is placed on the surface facing in the first direction D1, the concave portion 142*b* being formed in the surface, and two seal support portions 142*d* are placed on the surface facing in the second direction D2. When the pressing surface 159*a* of the lid member 159 presses the elastic member 142 in the first direction D1 against the base body 156 through the seal support portions 142*d*, each seal support portion 142*d* is crushed by the pressing surface 159*a* of the lid member 159. Then, the seal support portions 142*d* is deformed so as to spread in directions orthogonal to the first direction D1, in which the seal support portion 142*d* is pressed. Therefore, the pressing surface 159*a* of the lid member 159 comes into tight contact with the surface of the elastic member 142, so the whole of the outer edge 142*a* of the elastic member 142 is sealed against the lid member 159. The lid member 159 has a communicating portion 159*e* through which the interior of the space 153 that has been sealed communicates with the air flow path 155. The communicating portion 159*e* and air flow path 155 communicate with each other through a coupling tube 146.

When the lid member 159 presses the elastic member 142 against the base body 156 in the first direction D1 and is fixed, the base body 156 presses the elastic member 142 against the lid member 159 in the second direction D2. Specifically, the support portion 156*b* of the base body 156 presses the elastic member 142 against the lid member 159 through the seal support portion 142*c* in the second direction D2. As a result, the seal support portion 142*d* is crushed by the support portion 156*b* of the base body 156 and the seal support portion 142*d* is thereby deformed and spreads in directions orthogonal to the second direction D2, in which the seal support portion 142*d* is pressed. Therefore, the support portion 156*b* of the base body 156 comes into tight contact with the surface of the elastic member 142, so the liquid chamber 141 is formed with the whole of the outer edge 142*a* of the elastic member 142 sealed against the base body 156.

The pressurizing mechanism 127 has a unit body 180 placed in the space 153. The unit body 180 is composed of a displaced member 181, an urging member 154, and a restricting member 191. One end 154*a* of the urging member 154 is supported by the surface 186 of the displaced member 181, and the other end 154*b* of the urging member 154 is supported by the support surface 196 of the restricting member 191. Thus, the one end 154*a* urges the surface 186 of the displaced member 181, and the other end 154*b* urges the support surface 196 of the restricting member 191. The attached portion 187 of the displaced member 181 in the unit body 180 is attached to the attachment portion 142*e* of the elastic member 142. The unit body 180 is placed in the space 153 in a state in which the abutting portions 197*a* of the restricting member 191 is placed in contact with the first ceiling surface 159*b* of the lid member 159.

When the abutting portions 197*a* of the restricting member 191 abuts the first ceiling surface 159*b*, the unit body 180 is placed in a state in which the displacement of the restricting member 191 in the second direction D2, in which the volume of the liquid chamber 141 is increased, is restricted by the lid member 159. This restricts the displacement of the other end 154*b*, which exerts the restricting member 191, in the second direction D2. Therefore, the displaced member 181 is displaced in the first direction D1, in which the volume of the liquid chamber 141 is reduced and urges the elastic member 142 while the displaced member 181 supports the one end 154*a*. That is, at the position of the one end 154*a* of the urging member 154, an urging force with which the urging member 154 urges the elastic member 142 through the displaced member 181 is exerted. The urging member 154 in the unit body 180 urges the elastic member 142 in the first direction D1, in which the volume of the liquid chamber 141 is reduced.

The restricting member 191 has locking portions 194 and 195 as restricting portions. The locking portions 194 and 195 restrict the displacement of the elastic member 142 in the first direction D1, in which the volume of the liquid chamber 141 is reduced, through the displaced member 181. The displaced member 181 has locked portions 184 and 185, which are respectively locked by the locking portions 194 and 195 during the displacement of the elastic member 142 in the first direction D1. When the displaced member 181 is displaced in the first direction D1, the locking surface 194*a* of the locking portion 194 locks the locked surface 184*a* of the locked portion 184. Similarly, the locking surface 195*a* of the locking portion 195 locks the locked surface 185*a* of the locked portion 185. At that position, therefore, the displacement of the displaced member 181 in the first direction D1 is restricted, the displaced member 181 supporting the one end 154*a*, at which an urging force with which the urging member 154 urges the elastic member 142 through the displaced member 181 is exerted. At that position, the displacement of the elastic member 142 in the first direction D1 is restricted. That is, the locking portions 194 and 195 respectively lock the locked portions 184 and 185 to restrict the displacement of the one end 154*a* so that the displacement of the elastic member 142 is restricted in the first direction D1, in which the volume of the liquid chamber 141.

Since at the time of the displacement of the elastic member 142 in the direction in which the volume of the liquid chamber 141 is reduced, the displacement of the elastic member 142 is restricted by the locking portions 194 and 195 used as restricting portions, a predetermined gap ΔG is formed between the base body 156 and the elastic member 142 in the liquid chamber 141. In other words, the unit body 180 restricts the displacement of the one end 154*a* of the urging member 154 in the first direction D1, in which the volume of the liquid chamber 141 is reduced, at a position at which the predetermined gap ΔG is formed between the base body 156 and the elastic member 142 in the liquid chamber 141.

The locking portions 194 and 195 used as restricting portions may be eliminated. When the locking portions 194 and 195 are eliminated, at the time of the displacement of the elastic member 142 in the direction in which the volume of the liquid chamber 141 is reduced, the displacement of the elastic member 142 is restricted by the support portion 156*b* used as a restricting portion, and the predetermined gap ΔG formed between the base body 156 and the elastic member 142 in the liquid chamber 141. In other words, at the position of the support portion 156*b* used as a restricting portion, the base body 156 restricts the displacement of the elastic member 142 in the direction in which the volume of the liquid chamber 141 is reduced so that the predetermined gap ΔG is formed between the base body 156 and the elastic member 142 in the liquid chamber 141.

When the predetermined gap ΔG is formed, the elastic member 142 receives, from the urging member 154, the urging force exerted in the direction in which the volume of the liquid chamber 141 is reduced. Upon the receipt of the urging force from the urging member 154, the elastic member 142 is displaced from the position indicated by the relevant dash-dot-dot lines in FIG. 6, at which the elastic member 142 receives no urging force from the urging member 154, to the position indicated by the relevant solid lines in FIG. 6, at which the elastic member 142 receives the urging force from the urging member 154. The support portion 156*b* included in the base body 156 is disposed at a position at which the inner part of the elastic member 142 with respect to the outer edge 142*a* does not come into contact with the base body 156 in the direction of the urging force when the elastic member 142 receives the urging force from the urging member 154.

Figure 7:
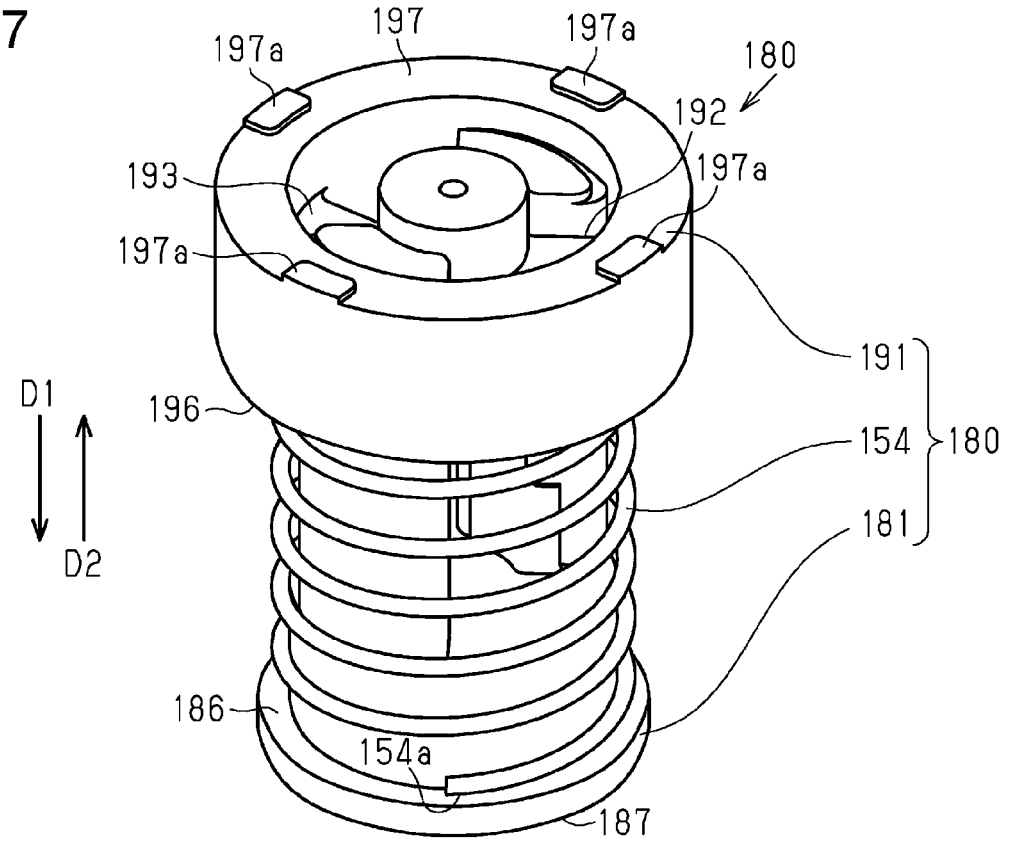
FIG. 7 is a perspective view illustrating a unit body disposed in the pressurizing mechanism.

The restricting member 191 has a substantially cylindrical shape with a low height as illustrated in FIG. 7. Four abutting portions 197*a* are placed on the upper surface 197 of the restricting member 191 so as to be substantially equally spaced around the center of the urging member 154. The urging member 154 is a helical compression spring. The displaced member 181 has a substantially cylindrical shape with a high height. The cylindrical part of the displaced member 181 is inserted into the hollow part of the helical compression spring. The cylindrical part is further inserted into holes 192 and 193 in the restricting member 191. Thus, the one end 154*a* of the urging member 154 is supported by the surface 186 of the displaced member 181, and the other end 154*b* of the urging member 154 is supported by the support surface 196 of the restricting member 191.

Figure 8:
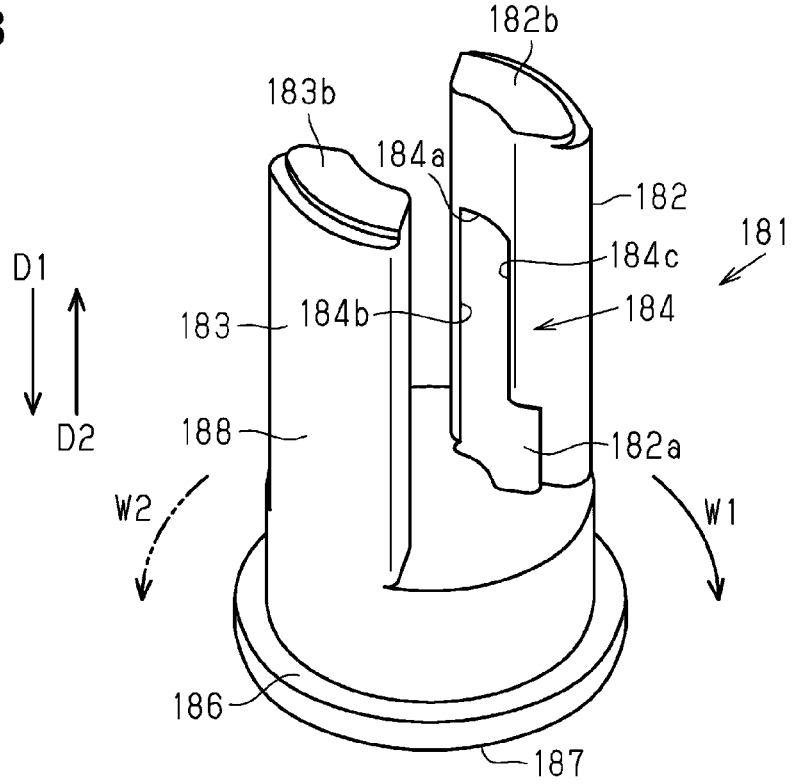
FIG. 8 is a perspective view illustrating a displaced member included in the unit body in FIG. 7.

The displaced member 181 has two columns 182 and 183 as illustrated in FIG. 8. The outer circumferential surface 188 of the two columns 182 and 183 is inserted into the hollow part of the urging member 154, so the outer circumferential surface 188 forms the side surface of the cylinder. The column 182 has the locked portion 184. The locked portion 184 has a hole, into which the locking portion 194 of the restricting member 191 is inserted. The locked portion 184 is composed of the locked surface 184*a* locked by the locking portion 194 as well as guide surfaces 184*b* and 184*c* that guide the locking portion 194 during the movement of the displaced member 181. The displaced member 181 has an insertion portion 182*a* at the bottom of the column 182 and on a surface of the column 182, the surface being on the same side as the downstream in the clockwise direction W1. The locking portion 194 is inserted into the insertion portion 182*a* so that the hole formed in the locked portion 184 is widened.

Figure 9:
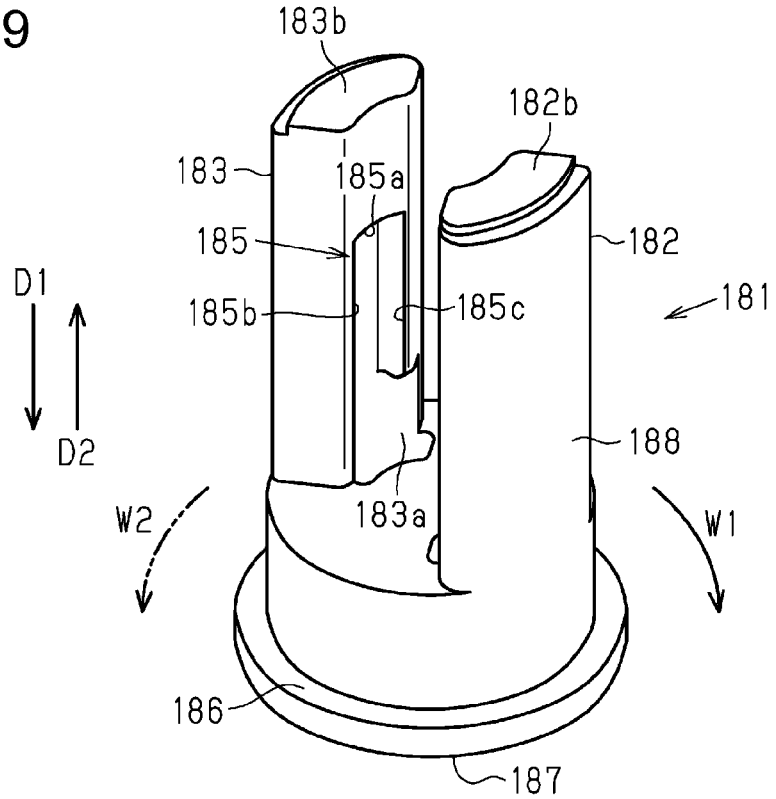
FIG. 9 is a perspective view when the displaced member in FIG. 8 is viewed from a different direction.

The column 183 has the locked portion 185 as illustrated in FIG. 9. The locked portion 185 has a hole, into which the locking portion 195 of the restricting member 191 is inserted. The locked portion 185 is composed of the locked surface 185*a* locked by the locking portion 195 as well as guide surfaces 185*b* and 185*c* that guide the locking portion 195 during the movement of the displaced member 181. The displaced member 181 has an insertion portion 183*a* at the bottom of the column 183 and on a surface of the column 183 on the same side as the downstream in the clockwise direction W1. The locking portion 195 is inserted into the insertion portion 183*a* so that the hole formed in the locked portion 185 is widened.

Figure 10:
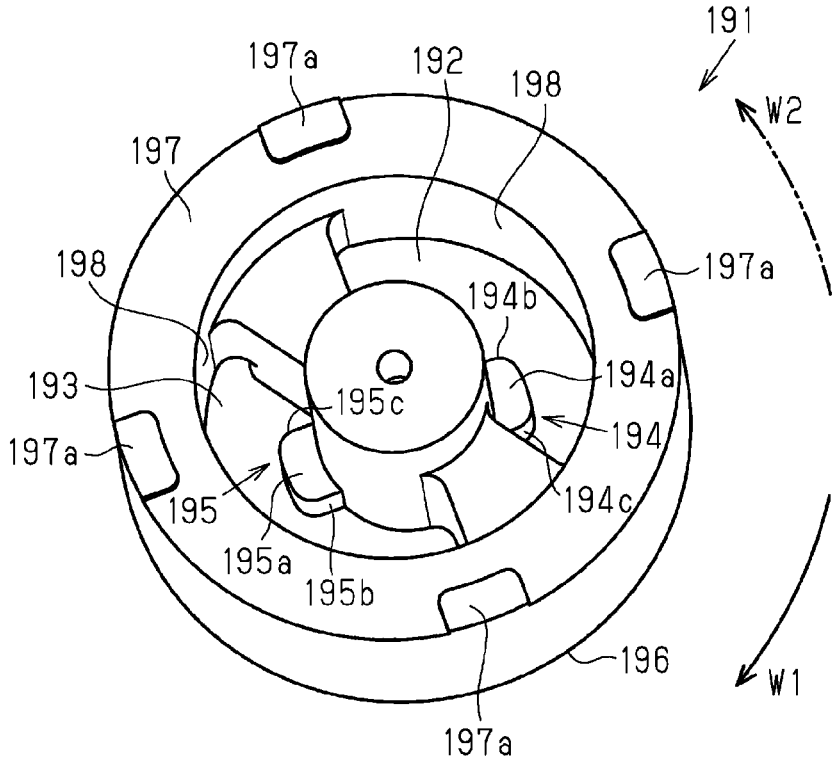
FIG. 10 is a perspective view illustrating a restricting member included in the unit body in FIG. 7.

The restricting member 191 has two holes 192 and 193 in a sectorial shape, into which the two columns 182 and 183 of the displaced member 181 are inserted, as illustrated in FIG. 10. The restricting member 191 has the locking portion 194 in a convex shape at a position on a surface forming part of the hole 192, the position being close to the downstream in the clockwise direction W1, the surface being on the same side as the center of the restricting member 191. The locking portion 194 is inserted into the locked portion 184 through the insertion portion 182*a* of the displaced member 181. The locking portion 194 is composed of the locking surface 194*a* that locks the locked portion 184 as well as guided surfaces 194*b* and 194*c* through which the locking portion 194 is guided during the movement of the displaced member 181.

The restricting member 191 has the locking portion 195 in a convex shape at a position on a surface forming part of the hole 193, the position being close to the downstream in the clockwise direction W1, the surface being on the same side as the center of the restricting member 191.

The locking portion 195 is inserted into the locked portion 185 through the insertion portion 183*a* of the displaced member 181. The locking portion 195 is composed of the locking surface 195*a* that locks the locked portion 185 as well as guided surfaces 195*b* and 195*c* through which the locking portion 195 is guided during the movement of the displaced member 181.

During the assembly of the unit body 180, the columnar part of the displaced member 181 is first inserted into the hollow part of the urging member 154, after which the surface 186 of the displaced member 181 is brought into contact with the one end 154*a* of the urging member 154, as illustrated in FIG. 7.

Figure 11:
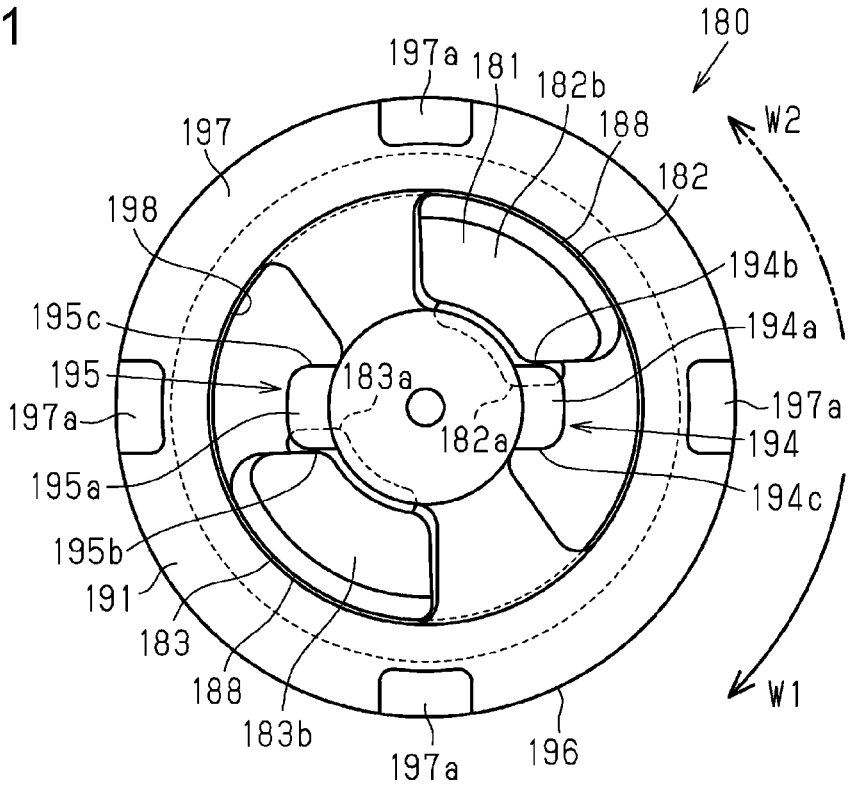
FIG. 11 is a plan view illustrating a positional relationship between the displaced member and the restricting member when the displaced member is inserted into the restricting member.

Then, the support surface 196 of the restricting member 191 is brought into contact with the other end 154*b* of the urging member 154, after which the two columns 182 and 183 of the displaced member 181 are respectively inserted into the holes 192 and 193 in the restricting member 191 while the urging member 154 is contracted, as illustrated in FIG. 11. At this time, the two columns 182 and 183 are respectively inserted into the holes 192 and 193 from positions in the holes 192 and 193, the positions being close to the downstream in the counterclockwise direction W2, so that the two columns 182 and 183 do not respectively come into contact with the locking portions 194 and 195. During the insertion of the displaced member 181 into the restricting member 191, the inner circumferential surface 198 of the restricting member 191 guides the outer circumferential surface 188 of the displaced member 181.

Figure 12:
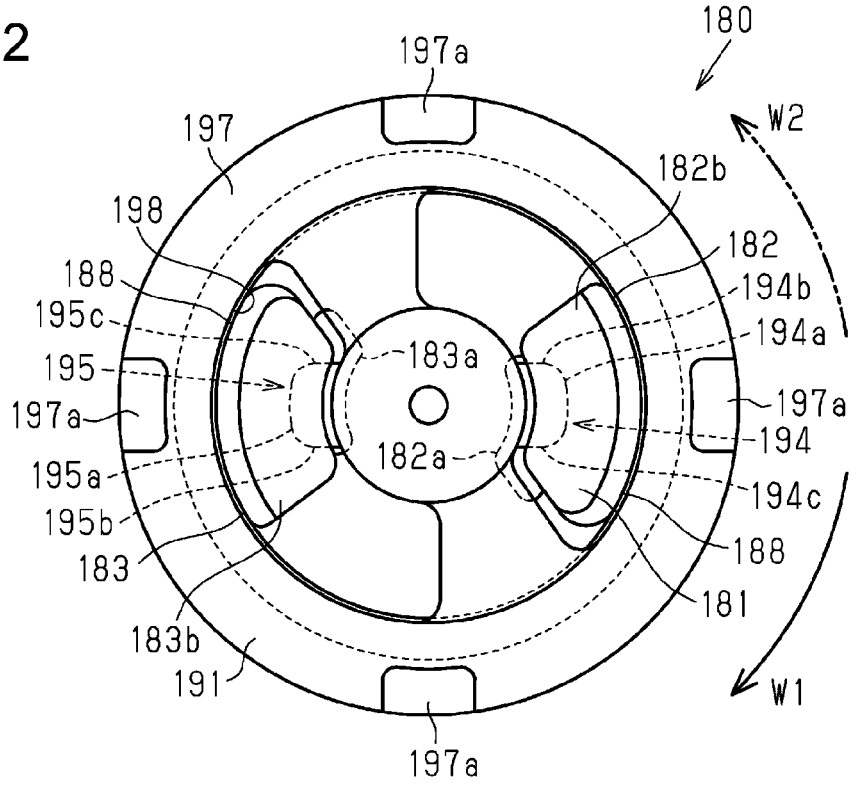
FIG. 12 s a plan view illustrating a positional relationship between the displaced member and the restricting member when the displaced member is displaced with respect to the restricting member.

When the two columns 182 and 183 of the displaced member 181 are respectively inserted into the holes 192 and 193 in the restricting member 191 until the urging member 154 is adequately contracted, the restricting member 191 is rotated in the clockwise direction W2 with the displaced member 181 fixed, as illustrated in FIG. 12. Thus, the two columns 182 and 183 respectively move to positions close to the downstream in the clockwise direction W1 in the holes 192 and 193. At this time, the locking portion 194 is inserted from the insertion portion 182*a* illustrated in FIG. 8 into the hole in the locked portion 184 illustrated in FIG. 8, and the locking portion 195 is inserted from the insertion portion 183*a* illustrated in FIG. 9 into the hole in the locked portion 185 illustrated in FIG. 9. When the force with which the urging member 154 has been contracted is released in this state, the displaced member 181 is displaced with the urging force of the urging member 154 with respect to the restricting member 191. At the same time, the locking portion 194 is guided by the guide surfaces 184*b* and 184*c* illustrated in FIG. 8 and the locking portion 195 is guided by the guide surfaces 185*b* and 185*c* illustrated in FIG. 9. The locking surface 194*a* illustrated in FIG. 10 locks the locked surface 184*a* illustrated in FIG. 8, and the locking surface 195*a* illustrated in FIG. 10 locks the locked surface 185*a* illustrated in FIG. 9. The unit body 180 is assembled as described above, entering a state in which displacement is restricted at the one end 154*a*, which is at the position at which the urging force is exerted, in the direction in which the urging force is exerted.

Figure 13:
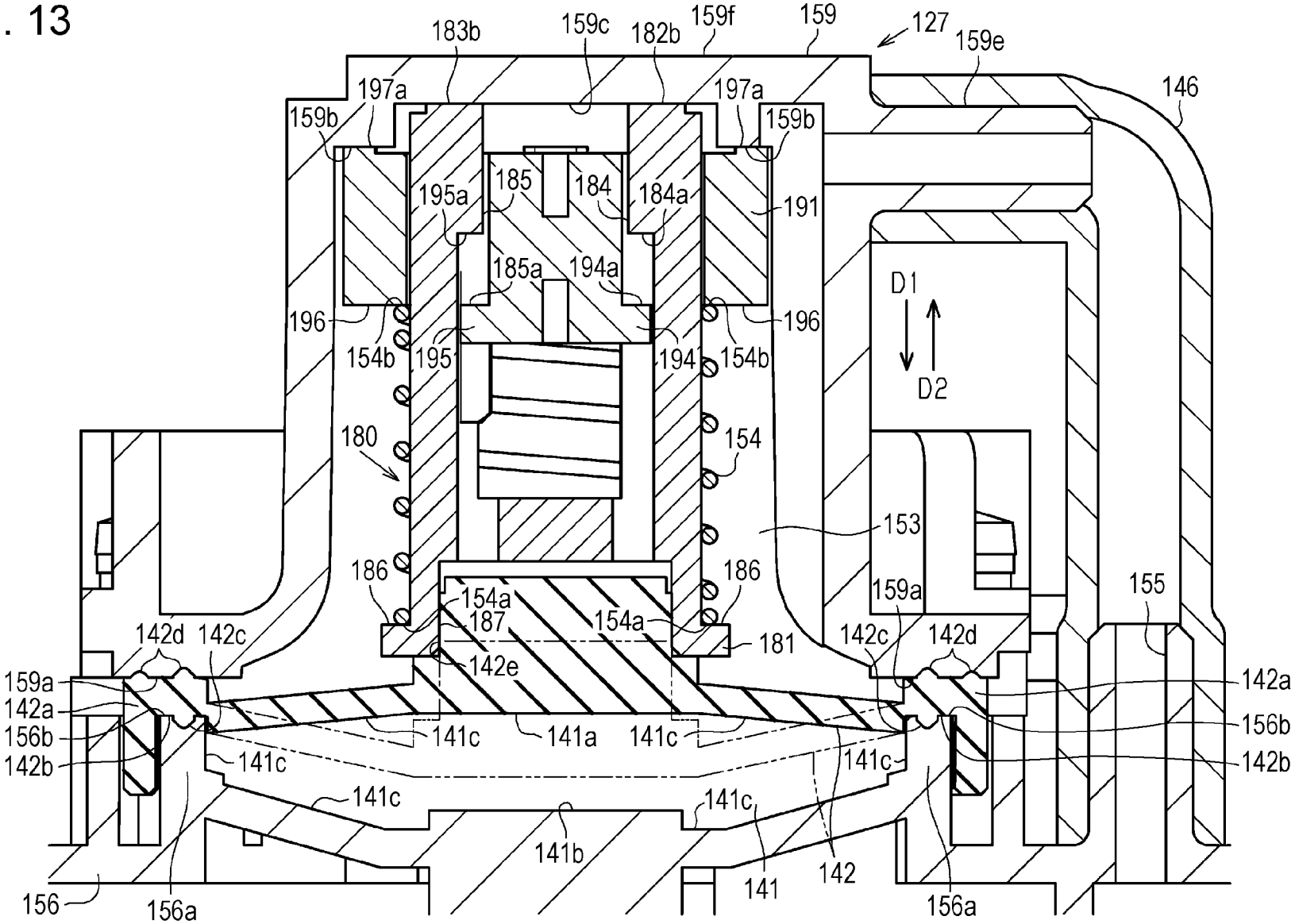
FIG. 13 is a side sectional view of the pressurizing mechanism in FIG. 6 when pressure in the space is reduced.

When the control portion 19 drives the depressurizing device 157*a* and air in the space 153 is thereby fed to the air flow path 155 through the communicating portion 159*e*, the interior of the space 153 is depressurized as illustrated in FIG. 13. At this time, the elastic member 142 is displaced against the urging force of the urging member 154 in the second direction D2, in which the volume of the liquid chamber 141 is increased, from the position indicated by the relevant dash-dot-dot lines in FIG. 13 to the position indicated by the relevant solid lines in FIG. 13. The outer circumferential surface 188 of the displaced member 181 is guided by the inner circumferential surface 198 of the restricting member 191, and the displaced member 181 is displaced in the second direction D2 along with the displacement of the elastic member 142. When the displaced member 181 is displaced in the second direction D2, column's upper surfaces 182*b* and 183*b* abut a second ceiling surface 159*c*. At the position of the second ceiling surface 159*c*, the displacement of the displaced member 181 is stopped. Since the interior of the liquid chamber 141 is depressurized in the second direction D2, it is also referred to as the depressurization direction.

When the control portion 19 stops the driving of the depressurizing device 157*a* and drives the atmosphere release device 157*b*, the interior of the space 153 is released to the air, as illustrated in FIG. 6. Thus, the drag against the urging force is eliminated and the urging force of the urging member 154 is exerted on the elastic member 142, placing the liquid chamber 141 in the pressurized state. Then, the elastic member 142 is displaced in the first direction D1, in which the volume of the liquid chamber 141 is reduced, from the position indicated by the relevant solid lines in FIG. 13 to the position indicated by the relevant solid lines in FIG. 6. The outer circumferential surface 188 of the displaced member 181 is guided by the inner circumferential surface 198, and the displaced member 181 is displaced in the first direction D1 along with the displacement of the elastic member 142. When the displaced member 181 is displaced in the first direction D1, the locked surface 184*a* abuts the locking surface 194*a* of the locking portion 194 and the locked surface 185*a* abuts the locking surface 195*a* of the locking portion 195. Then, the displacement of the displaced member 181 is stopped. That is, the locking portions 194 and 195 used as restricting portions restrict the displacement of the elastic member 142 in the direction in which the volume of the liquid chamber 141 is reduced. Since the interior of the liquid chamber 141 is pressurized in the first direction D1, it is also referred to as the pressurization direction.

Control Method in Placing the Liquid Chamber 141 in the Pressurized State

Figure 14:
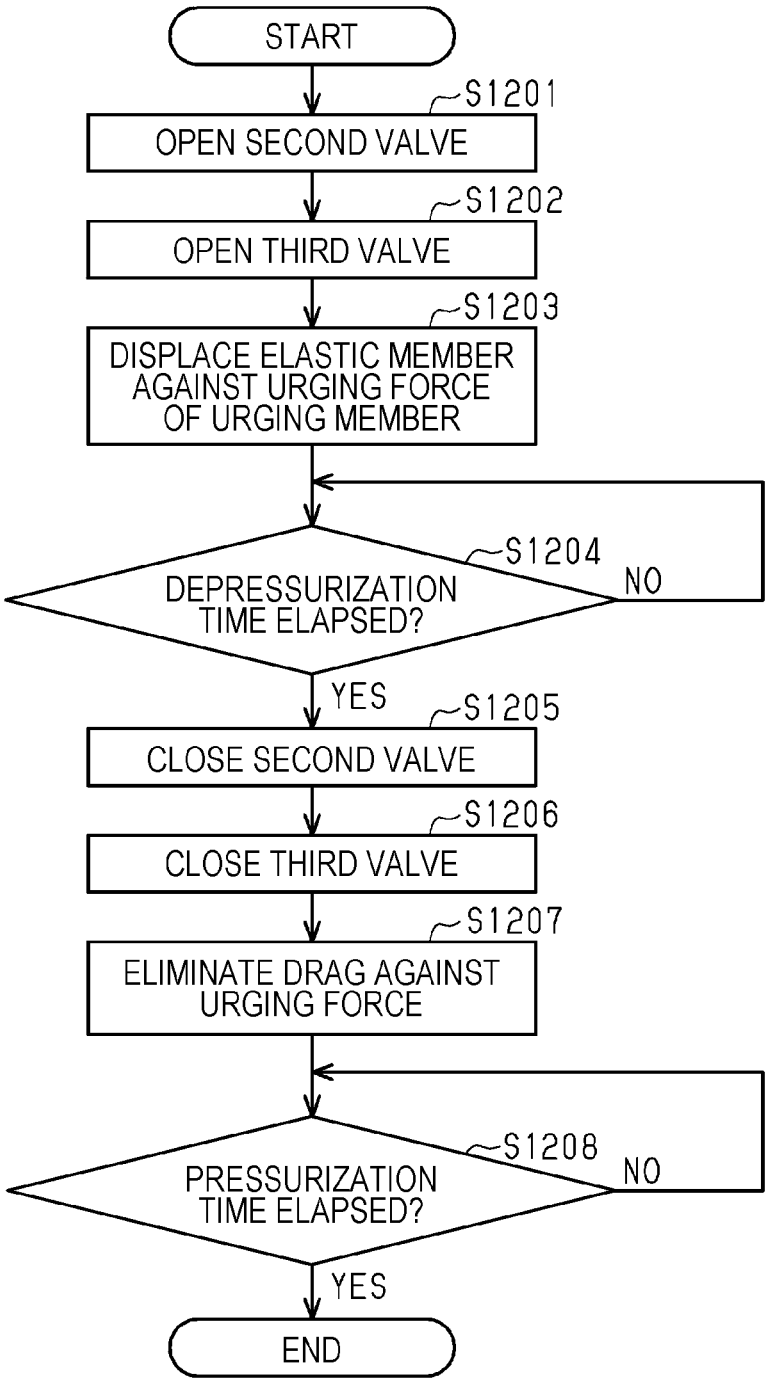
FIG. 14 is a flowchart when the liquid discharging apparatus in the second and third embodiments places a liquid chamber in a pressurized state.

In a control method executed when the liquid discharging apparatus 11 places the liquid chamber 141 in the pressurized state, control executed by the control portion 19 in steps will be described sequentially with reference to the flowchart in FIG. 14. In an initial state, the second valve 138, third valve 140, and all selections valves in the switching mechanism 148, which are illustrated in FIG. 5, are closed, and the elastic member 142 is positioned as illustrated in FIG. 6.

In step S1201, the control portion 19 opens the second valve 138. In step S1202, the control portion 19 opens the third valve 140. In step S1203, the control portion 19 depressurizes the interior of the space 153 by driving the depressurizing device 157*a* so as to displace the elastic member 142 in the direction in which the volume of the liquid chamber 141 is increased against the urging force of the urging member 154.

In step S1204, the control portion 19 decides whether a depressurization time has elapsed from when the space 153 was depressurized. The depressurization time is the time needed to displace the elastic member 142 in the depressurization direction and maximize the volume of the liquid chamber 141. When the depressurization time has elapsed, the elastic member 142 is positioned as illustrated in FIG. 13. Until the depressurization time elapses, step S1204 continues to produce a NO result, in which case the control portion 19 waits until the depressurization time elapses. When the depressurization time has elapsed, step S1204 produces a YES result, in which case the control portion 19 causes the process to proceed to step S1205.

In step S1205, the control portion 19 closes the second valve 138. In step S1206, the control portion 19 closes the third valve 140. In step S1207, to place the liquid chamber 141 in the pressurized state, the control portion 19 stops the driving of the depressurizing device 157*a* and eliminates the drag against the urging force by driving the atmosphere release device 157*b* to open the interior of the space 153 to the air so that the urging force of the urging member 154 is exerted on the elastic member 142.

In step S1208, the control portion 19 decides whether the pressurization time has elapsed from when the liquid chamber 141 was pressurized. The pressurization time is the time needed for pressure with which the space 153 is pressurized is transmitted to the nozzle 122 through the liquid chamber 141 and collection flow path 139. Until the pressurization time elapses, step S1208 continues to produce a NO result, in which case the control portion 19 waits until the pressurization time has elapsed. When the pressurization time has elapsed, step S1208 produces a YES result, in which case the control portion 19 terminates this flow. Alternatively, when step S1208 produces a YES result, the control portion 19 may cause the process to return to step S1201 and may continue to execute the flow without terminating the flow.

Steps S1201 and S1202 may be executed at the same time as step S1203 or after step S1203 has been executed. Steps S1205 and S1206 may be executed during the execution of step S1203, at the same time as the termination of step S1203, or after step S1203 has been executed. Steps S1205 and S1206 may be executed at the same time as step S1208 or after step S1208 has been executed.

Functions in the second embodiment will be described.

The displaced member 181, urging member 154, and restricting member 191 constitute the unit body 180. Even after the unit body 180 been assembled, it is in a state in which displacement 180 is restricted in the direction in which the urging force is exerted at the one end 154*a*, which is at the position at which the urging force is exerted. In the state in which the unit body 180 has been assembled, the urging member 154 does not by itself come off the unit body 180, so the unit body 180 can be easily handled.

During the assembling of the pressurizing mechanism 127, the displaced member 181 is attached to the elastic member 142, after which the unit body 180 is placed in the pressurizing mechanism 127 in a state in which the displacement of the restricting member 191 is restricted by the lid member 159 in the direction in which the volume of the liquid chamber 141 is increased. During the replacement of the unit body 180, the unit body 180 that has been used is also removed from a position between the elastic member 142 and the lid member 159, and a new unit body 180 is placed at that position. In the state in which the unit body 180 is assembled, the urging member 154 does not by itself come off the unit body 180, so the unit body 180 can be easily placed between the elastic member 142 and the lid member 159.

The liquid discharging apparatus 11 is assembled by including the pressurizing mechanism 127. The liquid discharging apparatus 11 is then factory-shipped and is used by the user. After printing has been repeated with the liquid discharging apparatus 11, pressurized cleaning is performed.

The second valve 138, which is an example of a supply-side shut-off valve, is opened, and the third valve 140, which is an example of a collection-side shut-off valve, is opened. When the control portion 19 causes the displacing device 157 to drive the depressurizing device 157*a*, the interior of the space 153 is depressurized. When the interior of the space 153 is depressurized, the elastic member 142 tends to undergo displacement in the second direction D2, in which the volume of the liquid chamber 141 is increased, against the urging force of the urging member 154. At this time, the displaced member 181 attached to the elastic member 142 tends to undergo displacement in the second direction D2 along with the displacement of the elastic member 142.

The displacement of the restricting member 191 is restricted in the second direction D2 by the lid member 159. During the displacement of the displaced member 181, the displaced member 181 and restricting member 191 are relatively displaced. At this time, the outer circumferential surface 188 of the displaced member 181 is guided by the inner circumferential surface 198 of the restricting member 191, and the guided surfaces 194*b* and 194*c* and guided surfaces 195*b* and 195*c* of the restricting member 191 are respectively guided by the guide surfaces 184*b* and 184*c* and guide surfaces 185*b* and 185*c* of the displaced member 181. Thus, the displaced member 181 can be displaced in the second direction D2, in which the volume of the liquid chamber 141 is increased, with respect to the restricting member 191. In addition, the elastic member 142 can be displaced in the second direction D2 along with the displacement of the displaced member 181 in the second direction D2.

During the displacement of the elastic member 142 in the second direction D2, the pressing surface 159*a* of the lid member 159 supports the outer edge 142*a* of the elastic member 142. This suppresses the displacement of the outer edge 142*a* of the elastic member 142 in the second direction D2. That is, since only the central part of the elastic member 142 can be displaced in the second direction D2 with the outer edge 142*a* of the elastic member 142 sealed, the liquid chamber 141 can be depressurized.

When the displaced member 181 is displaced in the second direction D2, the column's upper surfaces 182*b* and 183*b* of the displaced member 181 abut the second ceiling surface 159*c* of the lid member 159. At the abutting position, the displacement of the displaced member 181 is stopped. That is, the size of the volume of the liquid chamber 141 after the depressurization of the liquid chamber 141 can be set according to the position of the second ceiling surface 159*c* in the second direction D2.

When the liquid chamber 141 is placed in the depressurized state, the liquid flows from the first holding portion 133, which is an example of a liquid supply source, through the collection flow path 139 into the liquid chamber 141. Furthermore, the liquid also flows from the second holding portion 135, which is an example of a liquid supply source, through the supply flow path 137 into the liquid chamber 141. Thus, the liquid can be held in the liquid chamber 141 with an increased volume.

When the second valve 138, which is an example of a supply-side shut-off valve, is closed, the third valve 140, which is an example of a collection-side shut-off valve, is closed, and the control portion 19 causes the displacing device 157 to drive the atmosphere release device 157*b* so that the interior of the space 153 is opened to the air, the urging force of the urging member 154 is exerted on the elastic member 142 through the displaced member 181. The elastic member 142 tends to undergo displacement in the first direction D1, in which the volume of the liquid chamber 141 is reduced, together with the displaced member 181.

The displacement of the restricting member 191 is restricted in the second direction D2 by the lid member 159. During the displacement of the displaced member 181, the displaced member 181 and restricting member 191 are relatively displaced. At this time, the outer circumferential surface 188 of the displaced member 181 is guided by the inner circumferential surface 198 of the restricting member 191, and the guided surfaces 194*b* and 194*c* and guided surfaces 195*b* and 195*c* of the restricting member 191 are respectively guided by the guide surfaces 184*b* and 184*c* and guide surfaces 185*b* and 185*c* of the displaced member 181. Thus, the displaced member 181 can be displaced in the first direction D1, in which the volume of the liquid chamber 141 is reduced, with respect to the restricting member 191. In addition, the elastic member 142 can be displaced in the first direction D1 along with the displacement of the displaced member 181 in the first direction D1.

During the displacement of the elastic member 142 in the first direction D1 due to the urging force, the support portion 156*b*, used as a restricting portion, of the base body 156 supports the outer edge 142*a* of the elastic member 142. This suppresses the displacement of the outer edge 142*a* of the elastic member 142 in the first direction D1. That is, since only the central part of the elastic member 142 can be displaced in the first direction D1 with the outer edge 142*a* of the elastic member 142 sealed, the liquid chamber 141 can be pressurized.

During the displacement of the displaced member 181 in the first direction D1 due to the urging force, the locking portions 194 and 195, used as restricting portions, of the restricting member 191 respectively lock the locked portions 184 and 185 of the displaced member 181 to restrict the displacement of the one end 154*a*, which is at the position at which the urging force is exerted. Thus, the displacement of the elastic member 142 is restricted in the first direction D1, in which the volume of the liquid chamber 141 is reduced. At this position, the displacement of the displaced member 181 is stopped. At this time, the support portion 156*b*, used as a restricting portion, of the base body 156 supports the outer edge 142*a* of the elastic member 142. At the outer edge 142*a* of the elastic member 142, therefore, the displacement of the elastic member 142 is suppressed in the first direction D1. That is, the displacement of the elastic member 142 is suppressed in the first direction D1 by the locking portions 194 and 195 used as restricting portions and the support portion 156*b* also used as a restricting portion. Specifically, the support portion 156*b*, used as a restricting portion, of the base body 156 supports the outer edge 142*a* of the elastic member 142 to restrict the displacement of the elastic member 142 in the direction in which the volume of the liquid chamber 141 is reduced, after which the locking portions 194 and 195 used as restricting portions restrict the displacement of the one end 154*a*, which is at the position at which the urging force is exerted. Thus, the displacement of the elastic member 142 is restricted in the direction in which the volume of the liquid chamber 141 is reduced. The predetermined gap ΔG can be formed between the base body 156 and the elastic member 142 in the liquid chamber 141 depending on a positional relationship between the position of the displaced member 181 at the time when the locked portions 184 and 185 are respectively locked by the locking portions 194 and 195 and the position of the wall surface 141*b*, facing the elastic member 142, of the base body 156.

Even when the predetermined gap ΔG has been formed between the base body 156 and the elastic member 142 in the liquid chamber 141, the elastic member 142 receives the urging force of the urging member 154. When the predetermined gap ΔG has been formed, therefore, the elastic member 142 receives the urging force and is then placed in a deformed state from a free state, so a force with which the elastic member 142 recovers from the deformed state is generated in the elastic member 142. That is, in the elastic member 142, a recovery force is generated in the direction in which the volume of the liquid chamber 141 is increased. In this state, the elastic member 142 is not displaced in the direction in which the volume of the liquid chamber 141 is reduced as long as a variation in the pressure in the liquid chamber 141 does not exceed the restoration force of the elastic member 142. That is, the predetermined gap ΔG can be formed between the base body 156 and the elastic member 142 in the liquid chamber 141 in a state in which in the elastic member 142, a restoration force is generated in the direction in which the volume of the liquid chamber 141 is increased.

When the liquid chamber 141 is placed in the pressurized state, the pressurized liquid is fed to the liquid ejecting head 123 through the collection flow path 139. That is, pressurized cleaning can be performed by placing the liquid chamber 141 in the pressurized state and then discharging the liquid from the nozzle 122 in the liquid ejecting head 123.

Effects in the second embodiment will be described.

1. When the elastic member 142 is displaced by the locking portions 194 and 195, which are used as restricting portions that restrict the displacement of the elastic member 142, in the direction in which the volume of the liquid chamber 141 is reduced, the predetermined gapΔG is formed between the base body 156 and the elastic member 142 in the liquid chamber 141. This can suppress, in the liquid chamber 141, the wall surface 141*a* of the elastic member 142 from abutting the wall surface 141*b* of the base body 156, the wall surface 141*b* facing the elastic member 142, and can thereby suppress the wall surface 141*a* of the elastic member 142 and the wall surface 141*b* of the base body 156 from adhering to each other. In addition, it can be suppressed that when the wall surface 141*a*, sticking to the wall surface 141*b* of the base body 156, of the elastic member 142 comes off the wall surface 141*b*, a rapid change in pressure occurs in the liquid chamber 141 and meniscuses in the liquid in the nozzle 122 in the liquid ejecting head 123 are thereby broken.

When the locking portions 194 and 195 used as restricting portions are eliminated, the predetermined gap ΔG is formed between the base body 156 and the elastic member 142 in the liquid chamber 141 by the support portion 156*b* used as a restricting portion that restricts the displacement of the elastic member 142 during the displacement of the elastic member 142 in the direction in which the volume of the liquid chamber 141 is reduced. In other words, at the position of the support portion 156*b* used as a restricting portion, the base body 156 restricts the displacement of the elastic member 142 in the direction in which the volume of the liquid chamber 141 is reduced so that the predetermined gap ΔG is formed between the base body 156 and the elastic member 142 in the liquid chamber 141. This can suppress, in the liquid chamber 141, the wall surface 141*a* of the elastic member 142 from abutting the wall surface 141*b* of the base body 156, the wall surface 141*b* facing the elastic member 142, and can thereby suppress the wall surface 141*a* of the elastic member 142 and the wall surface 141*b* of the base body 156 from adhering to each other. In addition, it can be suppressed that when the wall surface 141*a*, sticking to the wall surface 141*b* of the base body 156, of the elastic member 142 comes off the wall surface 141*b*, a rapid change in pressure occurs in the liquid chamber 141 and meniscuses in the liquid in the nozzle 122 in the liquid ejecting head 123 are thereby broken.

2. Even when the predetermined gap ΔG has been formed between the base body 156 and the elastic member 142 in the liquid chamber 141, the elastic member 142 receives the urging force of the urging member 154. When the predetermined gap ΔG has been formed, therefore, the elastic member 142 receives the urging force and is then placed in a deformed state from a free state, so a force with which the elastic member 142 recovers from the deformed state is generated in the elastic member 142. That is, in the elastic member 142, recovery force is generated in the direction in which the volume of the liquid chamber 141 is increased. In this state, the elastic member 142 is not displaced in the direction in which the volume of the liquid chamber 141 is reduced as long as a variation in the pressure in the liquid chamber 141 does not exceed the restoration force of the elastic member 142. That is, since the predetermined gap ΔG is formed between the base body 156 and the elastic member 142 in the liquid chamber 141 in a state in which in the elastic member 142, a restoration force is generated in the direction in which the volume of the liquid chamber 141 is increased, the state in which the predetermined gap ΔG is formed can be stably maintained even when a change in pressure occurs somewhat.

3. When the support portion 156*b*, used as a restricting portion, of the base body 156 supports the outer edge 142*a* of the elastic member 142 and the elastic member 142 is displaced in the direction in which the volume of the liquid chamber 141 is reduced, the predetermined gap ΔG is formed between the base body 156 and the elastic member 142 in the liquid chamber 141, so the inner part of the elastic member 142 with respect to a part supported by the support portion 156*b* does not come into contact with the base body 156. This can suppress, in the liquid chamber 141, the wall surface 141*a* of the elastic member 142 from abutting the wall surface 141*b* of the base body 156, the wall surface 141*b* facing the elastic member 142, and can thereby suppress the wall surface 141*a* and the wall surface 141*b* of the base body 156 from adhering to each other. In addition, since the support portion 156*b* of the base body 156 supports the outer edge 142*a* of the elastic member 142 and the base body 156 and elastic member 142 form the liquid chamber 141 together, the elastic member 142 and base body 156 alone can form the predetermined gap ΔG between the base body 156 and the elastic member 142 in the liquid chamber 141 while the support portion 156*b* of the base body 156 seals the circumference of the elastic member 142. That is, the predetermined gap ΔG can be formed while the support portion 156*b* of the base body 156 seals the circumference of the elastic member 142, without having to use another member. Furthermore, even when the predetermined gapΔG is formed, it can be set that whether the elastic member 142 receives the urging force of the urging member 154, according to the position of the support portion 156*b* of the base body 156 in the direction of the urging force. That is, even when the predetermined gap ΔG is formed, it is possible to set the position of the support portion 156*b* in the direction of the urging force so that the elastic member 142 receives the urging force of the urging member 154. It is also possible to set the magnitude of the recovery force generated in the elastic member 142 when the elastic member 142 receives the urging force of the urging member 154, according to the position of the support portion 156*b* of the base body 156 in the direction of the urging force.

4. The locking portions 194 and 195, used as restricting portions, in the restricting member 191 respectively lock the locked portions 184 and 185 of the displaced member 181 to restrict the displacement of the one end 154*a*, which is at the position at which the urging force is exerted. Thus, the displacement of the elastic member 142 is restricted in the direction in which the volume of the liquid chamber 141 is reduced. This can suppress, in the liquid chamber 141, the wall surface 141*a* of the elastic member 142 from abutting the wall surface 141*b* of the base body 156, the wall surface 141*b* facing the elastic member 142, and can thereby suppress the wall surface 141*a* of the elastic member 142 and the wall surface 141*b* of the base body 156 from adhering to each other. The urging member 154 urges the elastic member 142 through the displaced member 181, so the locked portions 184 and 185 of the displaced member 181 are locked, restricting the displacement of the elastic member 142 in the direction in which the volume of the liquid chamber 141 is reduced. Therefore, it is possible to suppress the predetermined gap ΔG from being varied due to the deformation of the elastic member 142, unlike when the elastic member 142, which has flexibility, is directly locked. The predetermined gap ΔG can be formed between the base body 156 and the elastic member 142 in the liquid chamber 141 depending on a positional relationship between the position of the displaced member 181 at the time when the locked portions 184 and 185 are respectively locked by the locking portions 194 and 195 and the position of the wall surface 141*b*, facing the elastic member 142, of the base body 156. When the elastic member 142 receives the urging force of the urging member 154 and is thereby deformed, a recovery force is generated in the elastic member 142 in the direction in which the volume of the liquid chamber 141 is increased. The predetermined gapΔG can be formed between the elastic member 142 and the base body 156 depending on a positional relationship between the position of the displaced member 181 at the time when the locked portions 184 and 185 are respectively locked by the locking portions 194 and 195 and the position of the wall surface 141*b*, facing the elastic member 142 in the liquid chamber 141, of the base body 156, regardless of the magnitude of the recovery force. That is, since the volume of predetermined gap ΔG remains unchanged due to the recovery force of the elastic member 142, the precision of the predetermined gap ΔG can be improved. Furthermore, the restricting member 191 restricts the displacement of the one end 154*a*, which is at the position at which the urging force is exerted, by locking the locked portions 184 and 185 of the displaced member 181 while supporting the other end 154*b* of the urging member 154. That is, since the one end 154*a* and other end 154*b* of the urging member 154 are restricted by the same member, the precision of the urging force with which the urging member 154 urges the elastic member 142 can be improved.

5. The support portion 156*b*, used as a restricting portion, of the base body 156 supports the outer edge 142*a* of the elastic member 142 to restrict the displacement of the elastic member 142 in the direction in which the volume of the liquid chamber 141 is reduced, after which the locking portions 194 and 195 used as restricting portions restrict the displacement of the one end 154*a*, which is at the position at which the urging force is exerted. Thus, the displacement of the elastic member 142 is restricted in the direction in which the volume of the liquid chamber 141 is reduced. Therefore, the predetermined gap ΔG can be formed between the elastic member 142 and the base body 156 depending on a positional relationship between the position of the displaced member 181 at the time when the locked portions 184 and 185 are respectively locked by the locking portions 194 and 195 and the position of the wall surface 141*b*, facing the elastic member 142 in the liquid chamber 141, of the base body 156. Furthermore, even when the predetermined gap ΔG is formed, it can be set that whether the elastic member 142 receives the urging force of the urging member 154, according to a positional relationship between the position of the displaced member 181 at the time when the locked portions 184 and 185 are respectively locked by the locking portions 194 and 195 and the position of the support portion 156*b*, used as a restricting portion, of the base body 156. That is, even when the predetermined gap ΔG is formed, it is possible to set the position of the support portion 156*b* in the direction of the urging force so that the elastic member 142 receives the urging force of the urging member 154. While the size of the predetermined gap ΔG is maintained, it is also possible to set the magnitude of the recovery force generated in the elastic member 142, according to the positional relationship between the position of the displaced member 181 at the time when the locked portions 184 and 185 are respectively locked by the locking portions 194 and 195 and the position of the support portion 156*b*, used as a restricting portion, of the support portion 156*b*. That is, while the size of the predetermined gap ΔG is maintained, it is also possible to set the magnitude of the recovery force generated in the elastic member 142 when the elastic member 142 receives the urging force of the urging member 154.

6. The displaced member 181, urging member 154, and restricting member 191 constitute the unit body 180 in a state in which displacement is restricted in the direction in which the urging force is exerted at the one end 154*a*, which is at the position at which the urging force is exerted. The unit body 180 is placed in the pressurizing mechanism 127 in a state in which the displaced member 181 is attached to the elastic member 142, and the displacement of the restricting member 191 is restricted by the lid member 159 in the direction in which the volume of the liquid chamber 141 is increased. The recovery force of the elastic member 142 against the urging force with which the urging member 154 urges the elastic member 142 is smaller than the urging force. Therefore, even when the unit body 180 is placed in the pressurizing mechanism 127, displacement in the direction in which the urging force is exerted at the one end 154*a*, which is at the position at which the urging force is exerted remains in the state in which the displacement is restricted at the same position. However, the elastic member 142 receives, from the urging member 154, the urging force exerted in the direction in which the volume of the liquid chamber 141 is reduced, and is thereby displaced from the position before the unit body 180 is placed in the direction in which the volume of the liquid chamber 141 is reduced. Then, the predetermined gap ΔG is formed between the base body 156 and the elastic member 142 in the liquid chamber 141. The position of the elastic member 142 at the time when the unit body 180 is placed in the pressurizing mechanism 127 is the position of the elastic member 142 at the time when the elastic member 142 is displaced in the direction in which the volume of the liquid chamber 141 is reduced. Therefore, the size of the predetermined gap ΔG at the time when the elastic member 142 is displaced in the direction in which the volume of the liquid chamber 141 is reduced and the magnitude of the urging force with which the urging member 154 urges the elastic member 142 depend on the unit body 180. That is, by displacing the unit body 180, the size of the predetermined gap ΔG and the magnitude of the urging force can be easily adjusted. After the unit body 180 has been assembled, it is in a state in which displacement is restricted in the direction in which the urging force is exerted at the one end 154*a*, which is at the position at which the urging force is exerted. Therefore, the urging member 154 does not by itself come off the unit body 180, placing the unit body 180 in an easy-to-handle state. During the assembly of the pressurizing mechanism 127, it is only necessary that the unit body 180 in the assembled state is just placed between the elastic member 142 and the lid member 159. This makes the assembling work of the pressurizing mechanism 127 easy. During the replacement of the unit body 180, it is only necessary that the unit body 180 that has been used is removed from a position between the elastic member 142 and the lid member 159, and a new unit body 180 is placed at that position. This makes the replacement work of the unit body 180 easy.

7. The pressurizing device 158 having the pressurizing mechanism 127 described above and the displacing device 157 can also provide functions and effects similar to those provided by the pressurizing mechanism 127 described above. It is also possible to depressurize the liquid chamber 141 by causing the displacing device 157 to displace the elastic member 142 in the direction in which the volume of the liquid chamber 141 is increased against the urging force of the urging member 154 and to pressurize the liquid chamber 141 with the urging force of the urging member 154 by keeping the displacing device 157 from displacing the elastic member 142. That is, the depressurization and pressurization of the liquid chamber 141 are both possible.

8. The liquid discharging apparatus 11 having the liquid ejecting head 123, supply flow path 137, collection flow path 139, and displacing device 157 as well as the pressurizing mechanism 127 described above can also provide functions and effects similar to those provided by the pressurizing mechanism 127 described above. It is also possible to depressurize the liquid chamber 141 by causing the displacing device 157 to displace the elastic member 142 in the direction in which the volume of the liquid chamber 141 is increased against the urging force of the urging member 154 and to pressurize the liquid chamber 141 with the urging force of the urging member 154 by keeping the displacing device 157 from displacing the elastic member 142. That is, in the pressurizing mechanism 127 disposed at some point in any one of the supply flow path 137, through which the liquid is supplied from the second holding portion 135, which is an example of a liquid supply source, to the liquid ejecting head 123, and the collection flow path 139, through which the liquid that has not been used in the liquid ejecting head 123 is collected, the depressurization and pressurization of the liquid chamber 141 can be both performed.

9. When the third valve 140, which is an example of a collection-side shut-off valve, is opened, in the pressurizing mechanism 127, the elastic member 142 is displaced by the displacing device 157 in the direction in which the volume of the liquid chamber 141 is increased against the urging force of the urging member 154, and the liquid chamber 141 is thereby placed in the depressurized state, the liquid flows from the first holding portion 133, which is an example of a liquid supply source, through the collection flow path 139, into the liquid chamber 141. Then, when the third valve 140, which is an example of a collection-side shut-off valve, is closed and the urging force of the urging member 154 is then exerted on the elastic member 142 by keeping the displacing device 157 from displacing the elastic member 142, the liquid chamber 141 is placed in the pressurized state. Since the third valve 140, which is an example of a collection-side shut-off valve, has been closed, the pressurized liquid is fed to the liquid ejecting head 123 through the collection flow path 139. In the liquid discharging apparatus 11, therefore, pressurized cleaning in which the liquid is discharged from the nozzle 122 in the liquid ejecting head 123 can be performed.

10. When the control portion 19 drives the depressurizing device 157*a*, the interior of the space 153 is depressurized and the elastic member 142 is thereby displaced toward the lid member 159. Thus, the liquid chamber 141 can be depressurized. When the control portion 19 drives the atmosphere release device 157*b* after that so that the interior of the space 153 is opened to the air, the urging force of the urging member 154 is exerted on the elastic member 142. Thus, the liquid chamber 141 can be pressurized. That is, in the pressurizing mechanism 127 disposed at some point in a liquid flow path, the depressurization and pressurization of the liquid chamber 141 can be both performed by depressurizing the interior of the space 153, which is a mechanism having a simple structure, and opening its interior to the air. In the liquid discharging apparatus 11, therefore, pressurized cleaning in which the liquid is discharged from the nozzle 122 in the liquid ejecting head 123 can be performed.

Third Embodiment

A pressurizing mechanism, a pressurizing device, and a liquid discharging apparatus in a third embodiment will be described with reference to the drawings. The third embodiment is substantially the same as the second embodiment. Therefore, the same component elements will be given the same reference numerals, and repeated descriptions will be omitted. Only the difference from the second embodiment will be described.

Structure of the Pressurizing Mechanism 127

Figure 15:
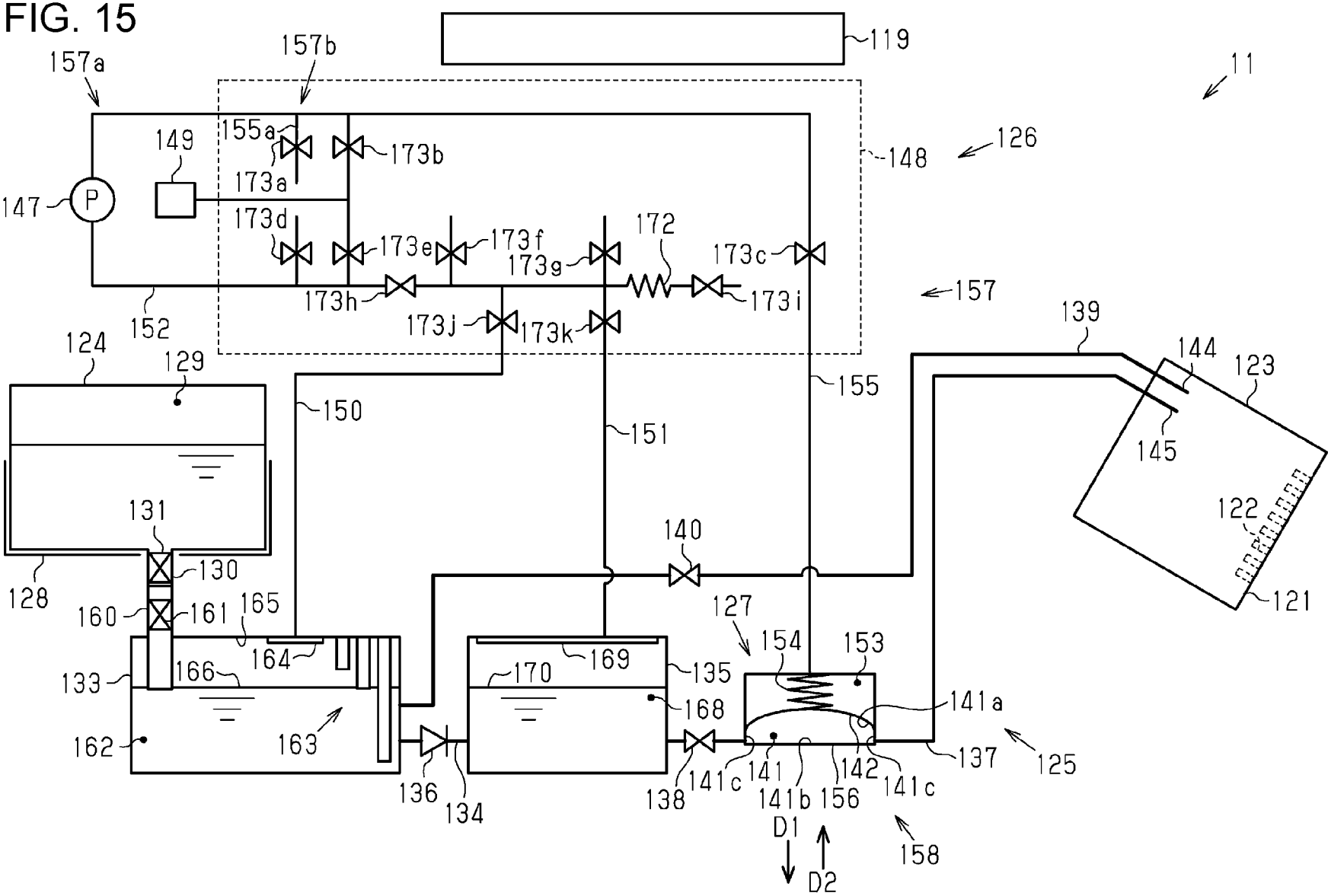
FIG. 15 is a schematic view illustrating the liquid discharging apparatus in the third embodiment.

As illustrated in FIG. 15, the pressurizing mechanism 127 is disposed at some point in a liquid flow path through which the liquid flows. Specifically, the pressurizing mechanism 127 is disposed at some point in any one of the supply flow path 137 and collection flow path 139. In the third embodiment, the pressurizing mechanism 127 is disposed in the supply flow path 137, which is an example of a liquid flow path. The second valve 138 is a collection-side shut-off valve that can open and close the supply flow path 137. The second valve 138 is disposed in the supply flow path 137 so as to be closer to the second holding portion 135, which is an example of a liquid supply source, than is the pressurizing mechanism 127.

The pressurizing mechanism 127 has a base body 156, an elastic member 142 having flexibility, and an urging member 154. The base body 156 is part of the wall surfaces 141*a*, 141*b*, and 141*c* of a liquid chamber 141 communicating with the supply flow path 137. The elastic member 142 is disposed at a position at which the elastic member 142 faces the base body 156. The elastic member 142 is part of the wall surfaces 141*a*, 141*b*, and 141*c* of the liquid chamber 141. The elastic member 142 is displaced so as to increase or decrease the volume of the liquid chamber 141. The urging member 154 urges the elastic member 142 in a first direction D1, in which the volume of the liquid chamber 141 is reduced.

Functions in the third embodiment will be described.

In the third embodiment, descriptions of the same functions as in the second embodiment will also be omitted.

The second valve 138, which is an example of a supply-side shut-off valve, is opened, and the third valve 140, which is an example of a collection-side shut-off valve, is opened. When the control portion 19 causes the displacing device 157 to drive the depressurizing device 157*a*, the interior of the space 153 is depressurized. When the interior of the space 153 is depressurized, the elastic member 142 is displaced in the second direction D2, in which the volume of the liquid chamber 141 is increased, against the urging force of the urging member 154.

When the liquid chamber 141 is placed in the depressurized state, the liquid flows from the second holding portion 135, which is an example of a liquid supply source, through the supply flow path 137 into the liquid chamber 141. Furthermore, the liquid also flows from the first holding portion 133, which is an example of a liquid supply source, through the supply flow path 139 into the liquid chamber 141. Thus, the liquid can be held in the liquid chamber 141 with an increased volume.

When the second valve 138, which is an example of a supply-side shut-off valve, is closed, the third valve 140, which is an example of a collection-side shut-off valve, is closed, and the control portion 19 causes the displacing device 157 to drive the atmosphere release device 157*b* so that the interior of the space 153 is opened to the air, the urging force of the urging member 154 is exerted on the elastic member 142 through the displaced member 181. The elastic member 142 is displaced in the first direction D1, in which the volume of the liquid chamber 141 is reduced, together with the displaced member 181.

When the liquid chamber 141 is placed in the pressurized state, the pressurized liquid is fed to the liquid ejecting head 123 through the supply flow path 137. That is, pressurized cleaning can be performed by placing the liquid chamber 141 in the pressurized state and then discharging the liquid from the nozzle 122 in the liquid ejecting head 123.

Effects in the Third Embodiment will be Described.

In the control method in the liquid discharging apparatus 11, the same effects as in 1. to 8. and 10. in the second embodiment are obtained.

11. The liquid discharging apparatus 11 having the liquid ejecting head 123, supply flow path 137, and displacing device 157 as well as the pressurizing mechanism 127 described above can also provide functions and effects similar to those provided by the pressurizing mechanism 127 described above. It is also possible to depressurize the liquid chamber 141 by causing the displacing device 157 to displace the elastic member 142 in the direction in which the volume of the liquid chamber 141 is increased against the urging force of the urging member 154 and to pressurize the liquid chamber 141 with the urging force of the urging member 154 by keeping the displacing device 157 from displacing the elastic member 142. That is, in the pressurizing mechanism 127 disposed at some point in the supply flow path 137, through which the liquid is supplied from the first holding portion 133, which is an example of a liquid supply source, to the liquid ejecting head 123, the depressurization and pressurization of the liquid chamber 141 can be both performed.

12. When the second valve 138, which is an example of a supply-side shut-off valve, is opened, in the pressurizing mechanism 127, the elastic member 142 is displaced by the displacing device 157 in the direction in which the volume of the liquid chamber 141 is increased against the urging force of the urging member 154, and the liquid chamber 141 is thereby placed in the depressurized state, the liquid flows from the second holding portion 135, which is an example of a liquid supply source, through the supply flow path 137, into the liquid chamber 141. Then, when the second valve 138, which is an example of a supply-side shut-off valve, is closed and the urging force of the urging member 154 is then exerted on the elastic member 142 by keeping the displacing device 157 from displacing the elastic member 142, the liquid chamber 141 is placed in the pressurized state. Since the second valve 138, which is an example of a supply-side shut-off valve, has been closed, the pressurized liquid is fed to the liquid ejecting head 123 through the supply flow path 137. In the liquid discharging apparatus 11, therefore, pressurized cleaning in which the liquid is discharged from the nozzle 122 in the liquid ejecting head 123 can be performed.

Fourth Embodiment

A pressurizing mechanism, a pressurizing device, and a liquid discharging apparatus in a fourth embodiment will be described with reference to the drawings. The fourth embodiment is substantially the same as the second embodiment. Therefore, the same component elements will be given the same reference numerals, and repeated descriptions will be omitted: Only the difference from the second embodiment will be described.

Structures of the Pressurizing Mechanism 127 and Displacing Device 157

Figure 16:
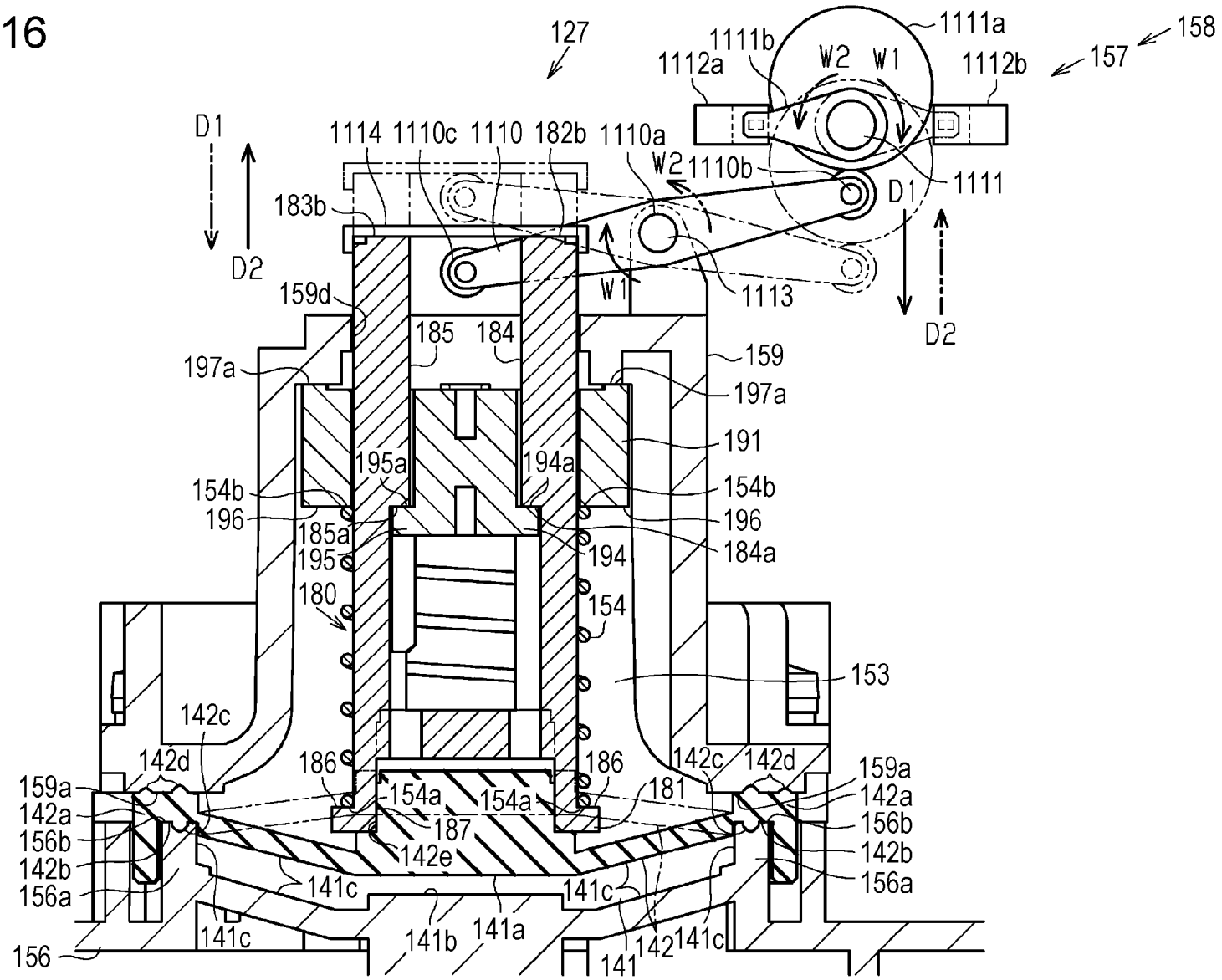
FIG. 16 is a schematic view illustrating the pressurizing mechanism and a displacing device in the fourth embodiment.

The displaced member 181 in the fourth embodiment differs from the displaced member 181 in the second embodiment in that the columns 182 and 183 have a shape that further extends in the second direction D2, as illustrated in FIG. 16. The lid member 159 has holes 159*d* in the second ceiling surface 159*c* so that the columns 182 and 183 extend beyond the upper surface 159*f* of the lid member 159. The columns 182 and 183 extend beyond the upper surface 159*f* of the lid member 159, and the column's upper surfaces 182*b* of the column 182 and the column's upper surface 183*b* of the column 183 are linked together by a linking member 1114.

The pressurizing device 158 is structured by adding the displacing device 157 to the pressurizing mechanism 127. The displacing device 157 exerts a drag against the urging force of the urging member 154 in the pressurizing mechanism 127 disposed in a liquid flow path and also eliminates the drag. The displacing device 157 has a lever 1110 that displaces the displaced member 181 in the second direction D2, an eccentric cam 1111*a* attached to a driving axis 1111, and a displacing motor (not illustrated) that rotates the driving axis 1111.

The lever 1110 has a fulcrum portion 1110*a* positioned substantially at the center, a point-of-effort portion 1110*b* positioned at one end, and a point-of-action portion 1110*c* positioned at the other end. The lever 1110 swings around a swing axis 1113 fixed to the lid member 159 with the fulcrum portion 1110*a* swingably supported by the swing axis 1113.

When the displacing motor (not illustrated) is driven, the eccentric cam 1111*a* rotates around the driving axis 1111 in the clockwise direction W1. Then, the outer circumference of the eccentric cam 1111*a* moves from the position indicated by the relevant solid line in FIG. 16 to the position indicated by the relevant dash-dot-dot line in the drawing, pushing down the point-of-effort portion 1110*b* in the first direction D1. Thus, the lever 1110 swings around the swing axis 1113 in the clockwise direction W1, and the point-of-action portion 1110*c* is displaced in the second direction D2. When the point-of-action portion 1110*c* is displaced in the second direction D2, the point-of-action portion 1110*c* raises the linking member 1114 from the position indicated by the relevant solid lines in FIG. 16 to the position indicated by the relevant dash-dot-dot lines in the drawing. The point-of-action portion 1110*c* exerts, on the linking member 1114, the drag against the urging force of the urging member 154. Thus, the displaced member 181 is displaced in the second direction D2 against the urging force of the urging member 154, and the elastic member 142 is displaced from the position indicated by the relevant solid lines in FIG. 16 to the position indicated by the relevant dash-dot-dot lines in the drawing in the direction in which the volume of the liquid chamber 141 is increased. This places the liquid chamber 141 in the depressurized state. That is, in the fourth embodiment, the displacing device 157 displaces the displaced member 181 in the second direction D2 due to the drag against the urging force of the urging member 154, so the liquid chamber 141 is placed in the depressurized state.

In addition, the eccentric cam 1111*a* rotates around the driving axis 1111 in the clockwise direction W1, so the outer circumference of the eccentric cam 1111*a* moves from the position indicated by the relevant dash-dot-dot line in FIG. 16 to the position indicated by the relevant solid line in the drawing, eliminating the force with which the point-of-effort portion 1110*b* is pushed down. Then, the point-of-effort portion 1110*b* becomes ready for being displaced in the second direction D2. That is, the lever 1110 becomes ready for swinging around the swing axis 1113 in the clockwise direction W2, and the point-of-action portion 1110*c* then becomes ready for being disposed in the first direction D1. Thus, the drag against the urging force of the urging member 154 is eliminated at the point-of-action portion 1110*c*. The urging force of the urging member 154 is exerted on the displaced member 181, and the displaced member 181 is thereby displaced in the first direction D1, exerting the urging force on the elastic member 142. Then, the elastic member 142 is displaced in the direction in which the volume of the liquid chamber 141 is reduced, from the position indicated by the relevant dash-dot-dot lines in FIG. 16 to the position indicated by the relevant solid lines in the drawing. This places the liquid chamber 141 in the pressurized state.

The displacing device 157 may be structured so that the displacing motor (not illustrated) is coupled to the driving axis 1111 through a clutch. When the clutch separates the rotation of the motor axis from the driving axis 1111, the drag against the urging force of the urging member 154 at the point-of-action portion 1110*c* may be eliminated.

The displacing device 157 has a first detection portion 1112*a*, a second detection portion 1112*b*, and a detected portion 1111*b* attached to the driving axis 1111. When the drag against the urging force of the urging member 154 is eliminated and the elastic member 142 then becomes ready for being displaced in the direction in which the volume of the liquid chamber 141 is reduced, the first detection portion 1112*a* detects the detected portion 1111*b*. When the displacing device 157 displaces the elastic member 142 with the drag against the urging force of the urging member 154 in the direction in which the volume of the liquid chamber 141 is increased, the second detection portion 1112*b* detects the detected portion 1111*b*.

In the pressurizing device 158, the control portion 19 pressurizes the liquid in the collection flow path 139 with the urging force of the urging member 154 in the pressurizing mechanism 127 disposed in the collection flow path 139 by driving the displacing device 157 and performing control so that the drag against the urging force in the pressurizing mechanism 127 is exerted or eliminated. The pressurizing mechanism 127 may be disposed in the supply flow path 137 as in the third embodiment.

Control Method in Placing the Liquid Chamber in the Pressurized State

Figure 17:
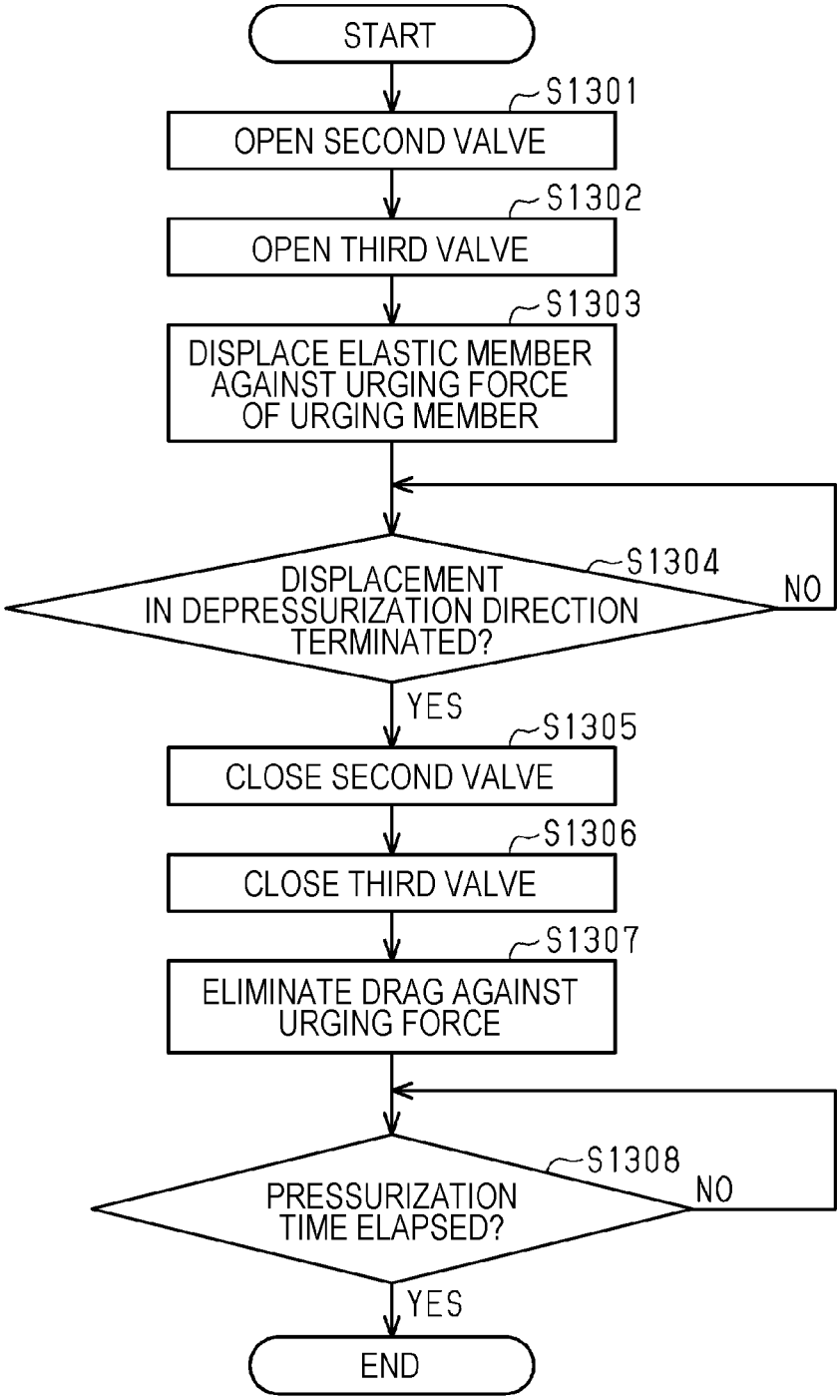
FIG. 17 is a flowchart when the liquid discharging apparatus in the fourth embodiment places the liquid chamber in the pressurized state.

In a control method executed when the liquid discharging apparatus 11 places the liquid chamber 141 in the pressurized state, control executed by the control portion 19 in steps will be described sequentially with reference to the flowchart in FIG. 17. In the fourth embodiment, the air flow path 155 illustrated in FIG. 5 is not coupled to the pressurizing mechanism 127. In an initial state, the second valve 138 and third valve 140 illustrated in FIG. 5 are closed and the elastic member 142 is positioned at the position indicated by the relevant solid lines in FIG. 16. In the state at this time, the first detection portion 1112*a* in FIG. 16 has detected the detected portion 1111*b*.

In step S1301, the control portion 19 opens the second valve 138. In step S1302, the control portion 19 opens the third valve 140. In step S1303, to place the liquid chamber 141 in the depressurized state, the control portion 19 displaces the elastic member 142 in the direction in which the volume of the liquid chamber 141 is increased with the drag against the urging force of the urging member 154 by driving the displacing device 157 so as to move the point-of-action portion 1110*c* in the second direction D2, which is the depressurization direction.

In step S1304, the control portion 19 decides whether the displacement of the elastic member 142 in the depressurization direction has been terminated. When the second detection portion 1112*b* detects the detected portion 1111*b*, the control portion 19 decides that the displacement of the elastic member 142 in the depressurization direction has been terminated and the elastic member 142 has been positioned at the position indicated by the relevant dash-dot-dot lines in FIG. 16. Until the second detection portion 1112*b* detects the detected portion 1111*b*, step S1304 continues to produce a NO result, in which case the control portion 19 waits until the displacement of the elastic member 142 in the depressurization direction is terminated. Upon detection of the detected portion 1111*b* by the second detection portion 1112*b*, step S1304 produces a YES result, in which case the control portion 19 causes the process to proceed to step S1305.

In step S1305, the control portion 19 closes the second valve 138. In step S1306, the control portion 19 closes the third valve 140. In step S1307, to place the liquid chamber 141 in the pressurized state, the control portion 19 eliminates the drag against the urging force by driving the displacing device 157 to move the point-of-action portion 1110*c* in the first direction D1, which is the pressurization direction, so that the urging force of the urging member 154 is exerted on the elastic member 142.

In step S1308, the control portion 19 decides whether the pressurization time has elapsed from when the liquid chamber 141 was pressurized. The pressurization time is the time needed for pressure with which the space 153 is pressurized is transmitted to the nozzle 122 through the liquid chamber 141 and collection flow path 139. Until the pressurization time elapses, step S1308 continues to produce a NO result, in which case the control portion 19 waits until the pressurization time elapses. When the pressurization time has elapsed, step S1308 produces a YES result, in which case the control portion 19 terminates this flow. Alternatively, when step S1308 produces a YES result, the control portion 19 may cause the process to return to step S1301 and may continue to execute the flow without terminating the flow.

Steps S1301 and S1302 may be executed at the same time as step S1303 or after step S1303 has been executed. Steps S1305 and S1306 may be executed during the execution of step S1303, at the same time as the termination of step S1303, or after step S1303 has been executed. Steps S1305 and S1306 may be executed at the same time as step S1307 or after step S1307 has been executed.

Functions in the fourth embodiment will be described.

The liquid discharging apparatus 11 is assembled by including the pressurizing mechanism 127. The liquid discharging apparatus 11 is then factory-shipped and is used by the user. After printing has been repeated with the liquid discharging apparatus 11, pressurized cleaning is performed.

The second valve 138, which is an example of a supply-side shut-off valve, is opened, and the third valve 140, which is an example of a collection-side shut-off valve, is opened. When the control portion 19 drives the displacing device 157 so as to displace the point-of-action portion 1110*c* of the displacing device 157 in the second direction D2, the drag against the urging force of the urging member 154 is exerted on the displaced member 181. The displaced member 181 receives the drag and is then displaced in the second direction D2.

The displacement of the restricting member 191 is restricted in the second direction D2 by the lid member 159.

During the displacement of the displaced member 181, the displaced member 181 and restricting member 191 are relatively displaced. At this time, the outer circumferential surface 188 of the displaced member 181 is guided by the inner circumferential surface 198 of the restricting member 191, and the guided surfaces 194*b* and 194*c* and guided surfaces 195*b* and 195*c* of the restricting member 191 are respectively guided by the guide surfaces 184*b* and 184*c* and guide surfaces 185*b* and 185*c* of the displaced member 181. Thus, the displaced member 181 can be displaced in the second direction D2, in which the volume of the liquid chamber 141 is increased, with respect to the restricting member 191. In addition, the elastic member 142 can be displaced in the second direction D2 along with the displacement of the displaced member 181 in the second direction D2.

During the displacement of the elastic member 142 in the second direction D2, the pressing surface 159*a* of the lid member 159 supports the outer edge 142*a* of the elastic member 142. This suppresses the displacement of the outer edge 142*a* of the elastic member 142 in the second direction D2. That is, since only the central part of the elastic member 142 can be displaced in the second direction D2 with the outer edge 142*a* of the elastic member 142 sealed, the liquid chamber 141 can be depressurized.

The displaced member 181 is displaced in the second direction D2 along with the displacement of the point-of-action portion 1110*c* of the displacing device 157. When the displacement of the point-of-action portion 1110*c* of the displacing device 157 is stopped, the displacement of the displaced member 181 is also stopped at that position. That is, the size of the volume of the liquid chamber 141 after the depressurization of the liquid chamber 141 can be set according to the position at which the point-of-action portion 1110*c* of the displacing device 157 is stopped in the second direction D2.

When the liquid chamber 141 is placed in the depressurized state, the liquid flows from the first holding portion 133, which is an example of a liquid supply source, through the collection flow path 139 into the liquid chamber 141. Furthermore, the liquid also flows from the second holding portion 135, which is an example of a liquid supply source, through the supply flow path 137 into the liquid chamber 141. Thus, the liquid can be held in the liquid chamber 141 with an increased volume.

When the second valve 138, which is an example of a supply-side shut-off valve, is closed, the third valve 140, which is an example of a collection-side shut-off valve, is closed, and the control portion 19 drives the displacing device 157 so as to displace the point-of-action portion 1110*c* of the displacing device 157 in the first direction D1, the drag against the urging force of the urging member 154 is eliminated. Thus, the urging force of the urging member 154 is exerted on the elastic member 142 through the displaced member 181. The elastic member 142 tends to undergo displacement in the first direction D1, in which the volume of the liquid chamber 141 is reduced, together with the displaced member 181.

When the liquid chamber 141 is placed in the pressurized state, the pressurized liquid is fed to the liquid ejecting head 123 through the collection flow path 139. That is, pressurized cleaning can be performed by placing the liquid chamber 141 in the pressurized state and then discharging the liquid from the nozzle 122 in the liquid ejecting head 123.

Effects in the Fourth Embodiment will be Described.

In the control method in the liquid discharging apparatus 11, the same effects in 1. to 12. in the second embodiment are obtained.

13. When the control portion 19 drives the displacing device 157, the elastic member 142 is displaced with the drag against the urging force of the urging member 154 in the direction in which the volume of the liquid chamber 141 is increased. Thus, the liquid chamber 141 can be depressurized. When the control portion 19 drives the displacing device 157 after that, the drag is eliminated and the urging force of the urging member 154 is exerted on the elastic member 142. Thus, the liquid chamber 141 can be pressurized. That is, in the pressurizing mechanism 127 disposed at some point in a liquid flow path the depressurization and pressurization of the liquid chamber 141 can be both performed when the control portion 19 drives the displacing device 157. In the liquid discharging apparatus 11, therefore, pressurized cleaning in which the liquid is discharged from the nozzle 122 in the liquid ejecting head 123 can be performed.

The second to fourth embodiments described above can be modified as described below and can be practiced. These embodiments and variations described below can be combined within a range in which any contradiction does not occur from a technical viewpoint.

The predetermined gap ΔG is formed between the base body 156 and the elastic member 142 in the liquid chamber 141 may be uniform across the entire surface or may not be uniform across the surface. For example, the central part of the wall surface 141*a* of the elastic member 142 may be the closest to the wall surface 141*b* of the base body 156, and the predetermined gap ΔG may be formed at the central part, as in the second to fourth embodiments.

A concave portion may be provided at a position corresponding to the support portion 156*b* of the base body 156 in the second to fourth embodiments described above. A convex portion may be provided at a position corresponding to the concave portion 142*b* in the elastic member 142 in the second to fourth embodiments described above. Then, the liquid chamber 141 may be formed in a state in which the concave portion and convex portion are engaged with each other so that the concave portion of the base body 156 supports the convex portion of the convex portion of the elastic member 142. That is, the support portion 156*b* used as a restricting portion may be a concave portion.

A support surface may be provided at a position corresponding to the support portion 156*b* of the base body 156 in the second to fourth embodiments described above in a direction orthogonal to the first direction D1. A supported surface may be provided at a position corresponding to the concave portion 142*b* of the elastic member 142 in the second to fourth embodiments described above in a direction orthogonal to the first direction D1. Then, the liquid chamber 141 may be formed in a state in which the support surface supports the supported surface. That is, the support portion 156*b* used as a restricting portion may be just a flat surface. The support portion 156*b* only needs to have a shape that can restrict the displacement of the elastic member 142 in the direction in which the volume of the liquid chamber 141 is reduced.

The number of locking portions, used as restricting portions, of the restricting member 191 is not limited to 2. The locking portion, used as a restricting portion, of the restricting member 191 only needs to be configured to restrict the displacement of the elastic member 142 in the direction in which the volume of the liquid chamber 141 is reduced. For example, the number of locking portions, used as restricting portions, of the restricting member 191 may be 1 or may be 4. However, when there are a plurality of locking portion, used as a restricting portion, of the restricting member 191, during the displacement of the elastic member 142 in the direction in which the volume of the liquid chamber 141 is reduced, it is possible to suppress a contact caused by the inclination of the elastic member 142 between the wall surface 141*a* of the elastic member 142 and the wall surface 141*b* of the base body 156.

In the pressurizing mechanism 127 in the second to fourth embodiments described above, the displaced member 181 has the locked portions 184 and 185, which are respectively locked by the locking portions 194 and 195 used as restricting portions. However, the pressurizing mechanism 127 may be structured so that the elastic member 142 has locked portions locked by the locking portions 194 and 195 used as restricting portions, and the locked portions in the elastic member 142 are locked by the locking portions 194 and 195 included in the restricting member 191. Even when the locked portions in the elastic member 142 are locked by the locking portions 194 and 195 included in the restricting member 191, the displacement of the elastic member 142 can be restricted in the direction in which the volume of the liquid chamber 141 is reduced. However, when the displaced member 181 has the locked portions 184 and 185, which are respectively locked by the locking portions 194 and 195 used as restricting portions, as in the second to fourth embodiments described above, it is possible to suppress variations in the predetermined gap ΔG that are caused when the locked portions of the elastic member 142 having flexibility are deformed.

The elastic member 142 and displaced member 181 may be formed as an integrated component. For example, the elastic member 142 and displaced member 181 may be structured as a single component by being integrally molded from a flexible material. That is, the elastic member 142 may have functions of the displaced member 181. However, when the elastic member 142 having flexibility is attached to the displaced member 181 as in the second to fourth embodiments described above, it is possible to suppress variations in the predetermined gap ΔG that are caused when the locked portions of the elastic member 142 integrally formed from a flexible material are deformed.

In the pressurizing mechanism 127 in the second to fourth embodiments described above, the restricting member 191 has the locking portions 194 and 195 used as restricting portions. However, the pressurizing mechanism 127 may be structured so that the lid member 159 has locking portions used as restricting portions, and the locked portions 184 and 185 of the displaced member 181 are locked by the locking portions included in the lid member 159. Even when the locked portions 184 and 185 of the displaced member 181 are locked by the locking portions included in the lid member 159, the displacement of the elastic member 142 can be restricted in the direction in which the volume of the liquid chamber 141 is reduced.

The lid member 159 and restricting member 191 may be formed as an integrated component. For example, the restricting member 191 may be fixed to the lid member 159. Alternatively, the lid member 159 and restricting member 191 may be structured as a single component by being integrally molded. That is, the lid member 159 may have functions of the restricting member 191. In this case, in the second and third embodiments described above, the lid member 159 may be structured so that the second ceiling surface 159*c* can be detached. After the urging member 154 and elastic member 142 have been attached to the lid member 159, the space 153 may be sealed by attaching the second ceiling surface 159*c* to the lid member 159.

In the supply flow path 137 or collection flow path 139, a one-way valve may be provided so as to be closer to the liquid supply source side than is the pressurizing device 158 and another one-way valve may be provided so as to be closer to the liquid ejecting head 123 than is the pressurizing device 158 so that the pressurizing device 158 is used as a flow path pump that feeds the liquid in the flow path in one way.

When the displacing device 157 includes the depressurizing device 157*a* that depressurizes the space 153, a structure in which the space 153 can be sealed by the lid member 159 is needed. However, when the displacing device 157 mechanically moves the elastic member 142 as in, for example, the fourth embodiment, the space 153 may be open.

What is claimed is:

1. A liquid circulating device comprising:

a supply flow path through which a liquid is supplied from a liquid supply source that stores the liquid to a liquid ejecting head that ejects the liquid;

a collection flow path through which the liquid collected from the liquid ejecting head is returned to the supply flow path; and a liquid flowing portion that causes the liquid to flow in a circulation flow path including the supply flow path, the liquid ejecting head, and the collection flow path; wherein an air capturing portion is configured to capture a bubble and is provided in at least one of the supply flow path and the collection flow path, and the air capturing portion is disposed at a position higher than a position of the liquid ejecting head.

2. The liquid circulating device according to claim 1, wherein:

the air capturing portion is composed of a turnaround portion provided in the at least one of the supply flow path and the collection flow path; and the turnaround portion is composed of a rising flow path through which the liquid rises and a falling flow path through which the liquid falls, the falling flow path being disposed downstream of the rising flow path in a circulation direction.

3. The liquid circulating device according to claim 2, wherein the air capturing portion is composed of a plurality of turnaround portions.

4. The liquid circulating device according to claim 1, wherein the air capturing portion is disposed at a highest position in the at least one of the supply flow path and the collection flow path.

5. The liquid circulating device according to claim 1, wherein the air capturing portion is disposed in the collection flow path.

6. The liquid circulating device according to claim 5, wherein a volume by which the liquid flowing portion causes the liquid to flow at one time is greater than a volume from the liquid ejecting head to the air capturing portion or a volume from the air capturing portion to the supply flow path, whichever is greater.

7. The liquid circulating device according to claim 1, wherein:

the supply flow path includes an upstream storing portion configured to store the liquid and a downstream storing portion configured to store the liquid;

in the supply flow path, the downstream storing portion is disposed downstream of the upstream storing portion in the circulation direction; and the collection flow path causes the liquid ejecting head and the upstream storing portion to mutually communicate.

8. The liquid circulating device according to claim 7, wherein when a volume obtained by subtracting a volume of liquid stored in the upstream storing portion from a maximum volume of the liquid is stored in the upstream storing portion is defined as a volume of air, a volume by which the liquid flowing portion causes the liquid to flow at one time is less than the volume of air.

9. The liquid circulating device according to claim 7, wherein a volume by which the liquid flowing portion causes the liquid to flow at one time is less than an volume of liquid stored in the downstream storing portion.

10. The liquid circulating device according to claim 7, further comprising a valve disposed in the supply flow path;

wherein the valve causes a flow of the liquid supplied from the upstream storing portion to the downstream storing portion but restricts a flow of the liquid from the downstream storing portion to the upstream storing portion.

11. A liquid discharging apparatus comprising:

a plurality of liquid circulating devices according to claim 7; and the liquid ejecting head that ejects the liquid; wherein the plurality of liquid circulating devices share a single liquid flowing portion, and the single liquid flowing portion has an air pressurizing portion that supplies air to a plurality of downstream storing portions to pressurize interiors of the plurality of downstream storing portions, and the air pressurizing portion is configured to concurrently pressurize the interiors of the plurality of downstream storing portions.

12. A bubble exhausting method in a liquid discharging apparatus that has a liquid ejecting head that ejects a liquid, a supply flow path through which the liquid is supplied from a liquid supply source that stores the liquid to the liquid ejecting head, a collection flow path through which the liquid collected from the liquid ejecting head is returned to the supply flow path, and a liquid flowing portion that causes the liquid to flow in a circulation flow path including the supply flow path, the liquid ejecting head, and the collection flow path, an air capturing portion is configured to capture a bubble and is provided in at least one of the supply flow path and the collection flow path, the air capturing portion being composed of a turnaround portion disposed at a position higher than a position of the liquid ejecting head in the at least one of the supply flow path and the collection flow path, the turnaround portion being composed of a rising flow path through which the liquid rises and a falling flow path through which the liquid falls, the falling flow path being disposed downstream of the rising flow path in a circulation direction, the method comprising:

a first flow process of causing the liquid flowing portion to cause the liquid to flow until a bubble present in the liquid ejecting head reaches the rising flow path or the falling flow path;

a wait process of waiting for an air capturing time in a state in which a flow of the liquid is stopped; and a second flow process of causing the liquid flowing portion to cause the liquid to flow until the bubble captured in the air capturing portion is fed to the supply flow path.

13. The bubble exhausting method according to claim 12, wherein:

the supply flow path includes an upstream storing portion configured to hold the liquid, the collection flow path being coupled to the upstream storing portion, and also includes a downstream storing portion configured to store the liquid, the downstream storing portion being disposed downstream of the upstream storing portion in a circulation direction; and when a volume obtained by subtracting a volume of liquid stored in the upstream storing portion from a maximum volume of the liquid is stored in the upstream storing portion is defined as a volume of air, a volume by which the liquid flows in each of the first flow process and the second flow process is less than the volume of air.

14. The bubble exhausting method according to claim 13, wherein the volume by which the liquid flows in each of the first flow process and the second flow process is less than an volume of liquid stored in the downstream storing portion before the each of the first flow process and the second flow process is started.

15. The bubble exhausting method according to claim 13, wherein the volume by which the liquid flows in each of the first flow process and the second flow process is greater than a volume from the liquid ejecting head to the air capturing portion or a volume from the air capturing portion to the upstream storing portion, whichever is greater.

* * * * *